US008449040B2

(12) United States Patent
Hall et al.

(10) Patent No.: US 8,449,040 B2
(45) Date of Patent: May 28, 2013

(54) SHANK FOR AN ATTACK TOOL

(76) Inventors: David R. Hall, Provo, UT (US); Ronald B. Crockett, Payson, UT (US); Jeff Jepson, Spanish Fork, UT (US)

( * ) Notice: Subject to any disclaimer, the term of this patent is extended or adjusted under 35 U.S.C. 154(b) by 552 days.

(21) Appl. No.: 11/927,917

(22) Filed: Oct. 30, 2007

(65) Prior Publication Data

US 2008/0048484 A1 Feb. 28, 2008

Related U.S. Application Data

(63) Continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256.

(51) Int. Cl.
*E21C 35/183* (2006.01)

(52) U.S. Cl.
USPC ..... 299/105; 299/111

(58) Field of Classification Search
USPC ..... 299/105, 111
See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford et al. |
| 1,821,474 | A | 9/1931 | Mercer |
| 1,879,177 | A | 9/1932 | Gault |
| 2,004,315 | A | 6/1935 | Fean |
| 2,054,255 | A | 9/1936 | Howard |
| 2,064,255 | A | 12/1936 | Garfield |
| 2,124,438 | A | 7/1938 | Struk et al. |
| 2,169,223 | A | 8/1939 | Christian |
| 2,218,130 | A | 10/1940 | Court |
| 2,247,499 | A | 7/1941 | Hutchison, Jr. |

(Continued)

FOREIGN PATENT DOCUMENTS

| | | |
|---|---|---|
| DE | 3 307 910 | 9/1984 |
| DE | 3 431 495 | 3/1986 |

(Continued)

OTHER PUBLICATIONS

Kennametal Inc., Catalog entitled "Construction Tools," 1997, pp. 1-20.

(Continued)

*Primary Examiner* — John Kreck
(74) *Attorney, Agent, or Firm* — Philip W. Townsend, III

(57) ABSTRACT

In one aspect of the invention, an attack tool is disclosed which comprises a wear-resistant base suitable for attachment to a driving mechanism. The wear-resistant base has a shank. A cemented metal carbide segment is bonded to the base and the shank has a wear-resistant surface. The wear-resistant surface has a hardness greater than 60 HRc and/or is work hardened.

11 Claims, 18 Drawing Sheets

U.S. PATENT DOCUMENTS 2,255,650 A 9/1941 Burke
2,320,136 A 5/1943 Kammerer
2,466,991 A 4/1949 Kammerer
2,540,464 A 2/1951 Stokes
2,544,036 A 3/1951 Kammerer
2,720,392 A 10/1955 Cartlidge
2,755,071 A 7/1956 Kammerer
2,776,819 A 1/1957 Brown
2,819,043 A 1/1958 Henderson
2,838,284 A 6/1958 Austin
2,972,713 A 6/1958 Sutton, Jr.
2,894,722 A 7/1959 Buttolph
2,901,223 A 8/1959 Scott
2,963,102 A 12/1960 Smith
2,989,295 A 6/1961 Prox, Jr.
3,089,215 A 5/1963 Stubbs
3,135,341 A 6/1964 Ritter
3,254,392 A 6/1966 Novkov
3,294,186 A 12/1966 Buell
3,301,339 A 1/1967 Pennebaker, Jr.
3,336,081 A 8/1967 Griffin
3,342,531 A 9/1967 Krekeler
3,342,532 A 9/1967 Krekeler
3,379,264 A 4/1968 Cox
3,397,012 A 8/1968 Krekeler
3,397,013 A 8/1968 Krekeler
3,429,390 A 2/1969 Bennett
3,429,617 A 2/1969 Lauber
3,468,553 A 9/1969 Ashby et al.
3,493,165 A 2/1970 Schonfeld
3,498,677 A 3/1970 Morrow
3,512,838 A 5/1970 Kniff
3,583,504 A 6/1971 Aalund
3,627,381 A 12/1971 Krekeler
3,650,565 A 3/1972 Kniff
3,655,244 A 4/1972 Swisher
3,745,396 A 7/1973 Quintal et al.
3,746,396 A 7/1973 Radd
3,751,115 A 8/1973 Proctor
3,765,493 A 10/1973 Rosar et al.
3,767,266 A 10/1973 Krekeler
3,778,112 A * 12/1973 Krekeler ..... 299/104
3,801,158 A 4/1974 Radd et al.
3,807,804 A 4/1974 Kniff
3,820,848 A 6/1974 Kniff
3,821,993 A 7/1974 Kniff et al.
3,830,321 A 8/1974 McKenry
3,833,265 A 9/1974 Elders
3,865,437 A 2/1975 Crosby
3,929,054 A 12/1975 Gutshall
3,932,952 A 1/1976 Helton et al.
3,942,838 A 3/1976 Bailey et al.
3,945,681 A 3/1976 White
3,955,635 A 5/1976 Skidmore
3,957,307 A 5/1976 Varda
3,960,223 A 6/1976 Kleine
4,005,914 A 2/1977 Newman
4,006,936 A 2/1977 Crabiel
4,081,042 A 3/1978 Johnson et al.
4,084,856 A 4/1978 Emmerich et al.
4,096,917 A 6/1978 Harris
4,098,362 A 7/1978 Bonnice
4,106,577 A 8/1978 Summers
4,109,737 A 8/1978 Bovenkerk
RE29,900 E 2/1979 Kniff
4,149,753 A 4/1979 Stoltz
4,156,329 A 5/1979 Daniels et al.
4,176,723 A 12/1979 Arceneaux
4,199,035 A 4/1980 Thompson
4,201,421 A 5/1980 Den Besten
4,247,150 A 1/1981 Wrulich et al.
4,251,109 A 2/1981 Roepke
4,253,533 A 3/1981 Baker, III
4,268,089 A 5/1981 Spence et al.
4,277,106 A 7/1981 Sahley
4,280,573 A 7/1981 Sudnishnikov et al.
4,289,211 A 9/1981 Lumen
4,304,312 A 12/1981 Larsson
4,307,786 A 12/1981 Evans
4,337,980 A 7/1982 Krekeler
4,397,361 A 8/1983 Langford, Jr.
4,397,362 A 8/1983 Dice et al.
4,416,339 A 11/1983 Baker et al.
4,439,250 A 3/1984 Acharya et al.
4,445,580 A 5/1984 Sahley
4,448,269 A 5/1984 Ishikawa et al.
4,453,775 A 6/1984 Clemmow
4,465,221 A 8/1984 Schmidt
4,484,644 A 11/1984 Cook
4,484,783 A 11/1984 Emmerich
4,489,986 A 12/1984 Dziak
4,497,520 A 2/1985 Ojanen
4,499,795 A 2/1985 Radtke
4,531,592 A 7/1985 Hayatdavoudi
4,535,853 A 8/1985 Ippolito et al.
4,537,448 A 8/1985 Ketterer
4,538,691 A 9/1985 Dennis
4,542,942 A 9/1985 Zitz et al.
4,566,545 A 1/1986 Story et al.
4,573,744 A 3/1986 Clemmow et al.
4,574,895 A 3/1986 Dolezal et al.
4,579,491 A 4/1986 Kull
4,583,786 A 4/1986 Thorpe et al.
4,627,665 A * 12/1986 Ewing et al. ..... 299/113
4,640,374 A 2/1987 Dennis
4,647,111 A 3/1987 Bronder et al.
4,657,308 A 4/1987 Clapham
4,660,890 A 4/1987 Mills
4,669,786 A 6/1987 Morgan et al.
4,678,237 A 7/1987 Collin
4,682,987 A 7/1987 Brady
4,684,176 A 8/1987 Den Besten et al.
4,688,856 A 8/1987 Elfgen
4,694,918 A 9/1987 Hall
4,702,525 A 10/1987 Sollami et al.
4,725,098 A 2/1988 Beach
4,728,153 A 3/1988 Ojanen et al.
4,729,603 A 3/1988 Elfgen
4,736,533 A 4/1988 May et al.
4,746,379 A 5/1988 Rabinkin
4,765,686 A 8/1988 Adams
4,765,687 A 8/1988 Parrott
4,776,862 A 10/1988 Wiand
4,798,026 A 1/1989 Cerceau
4,804,231 A 2/1989 Buljan et al.
4,811,801 A 3/1989 Salesky et al.
4,836,614 A 6/1989 Ojanen
4,850,649 A 7/1989 Beach et al.
4,852,672 A 8/1989 Behrens
4,880,154 A 11/1989 Tank
4,889,017 A 12/1989 Fuller et al.
4,893,875 A 1/1990 Lonn et al.
4,907,665 A 3/1990 Kar et al.
4,921,310 A 5/1990 Hedlund et al.
D308,683 S 6/1990 Meyers
4,932,723 A 6/1990 Mills
4,940,288 A 7/1990 Stiffler
4,941,711 A 7/1990 Stiffler
4,944,559 A 7/1990 Sionnet
4,945,073 A 7/1990 Dubensky et al.
4,951,762 A 8/1990 Lundell
4,956,238 A 9/1990 Griffin
4,962,822 A 10/1990 Pascale
RE33,494 E 12/1990 Hindmarsh et al.
4,981,184 A 1/1991 Knowlton et al.
5,007,685 A 4/1991 Beach et al.
5,009,273 A 4/1991 Grabinski
5,011,515 A 4/1991 Frushour
5,018,793 A 5/1991 Den Besten
5,027,914 A 7/1991 Wilson
5,038,873 A 8/1991 Jurgens
5,074,623 A 12/1991 Hedlund et al.
5,088,797 A 2/1992 O'Neill
5,092,310 A 3/1992 Walen et al.
5,106,166 A 4/1992 O'Neill
5,112,165 A 5/1992 Hedlund et al.
5,119,714 A 6/1992 Scott et al.

5,119,892 A 6/1992 Clegg et al.
5,141,063 A 8/1992 Quesenbury
5,141,289 A 8/1992 Stiffler
5,154,245 A 10/1992 Waldenstrom
5,186,268 A 2/1993 Clegg
5,186,892 A 2/1993 Pope
5,222,566 A 6/1993 Taylor et al.
5,235,961 A 8/1993 McShannon
5,251,964 A 10/1993 Ojanen
5,255,749 A 10/1993 Bumpurs et al.
5,261,499 A 11/1993 Grubb
5,265,682 A 11/1993 Russell et al.
D342,268 S 12/1993 Meyer
5,303,984 A 4/1994 Ojanen
5,311,654 A 5/1994 Cook
5,319,855 A 6/1994 Beevers et al.
5,332,051 A 7/1994 Knowlton
5,332,348 A 7/1994 Lemelson
5,333,938 A 8/1994 Gale
5,361,859 A 11/1994 Tibbitts
5,374,111 A 12/1994 Den Besten et al.
5,410,303 A 4/1995 Comeau et al.
5,415,462 A 5/1995 Massa
5,417,292 A 5/1995 Polakoff
5,417,475 A 5/1995 Graham et al.
5,423,389 A 6/1995 Warren et al.
5,447,208 A 9/1995 Lund
5,494,477 A 2/1996 Flood et al.
5,503,463 A 4/1996 Ojanen
5,507,357 A 4/1996 Hult et al.
5,535,839 A 7/1996 Brady
5,542,993 A 8/1996 Rabinkin
5,560,440 A 10/1996 Tibbitts
5,568,838 A 10/1996 Struthers et al.
5,653,300 A 8/1997 Lund
5,655,614 A 8/1997 Azar
5,662,720 A 9/1997 O'Tigheamaigh
5,678,644 A 10/1997 Fielder
5,713,412 A 2/1998 Wepfer et al.
5,720,528 A 2/1998 Ritchey
5,725,283 A 3/1998 O'Neill
5,730,502 A 3/1998 Montgomery, Jr.
5,732,784 A 3/1998 Nelson
5,738,415 A 4/1998 Parrott
5,738,698 A 4/1998 Kapoor et al.
5,794,728 A 8/1998 Palmberg
5,823,632 A 10/1998 Burkett
5,837,071 A 11/1998 Andersson et al.
5,842,747 A 12/1998 Winchester
5,845,547 A 12/1998 Sollami
5,848,657 A 12/1998 Flood et al.
5,875,862 A 3/1999 Jurewicz
5,884,979 A 3/1999 Latham
5,890,552 A 4/1999 Scott et al.
5,896,938 A 4/1999 Moeny et al.
5,934,542 A 8/1999 Nakamura
5,935,718 A 8/1999 Demo
5,944,129 A 8/1999 Jensen
5,947,215 A 9/1999 Lundell
5,950,742 A 9/1999 Caraway
5,950,743 A 9/1999 Cox
5,957,223 A 9/1999 Doster et al.
5,967,250 A 10/1999 Lund
5,992,405 A 11/1999 Sollami
6,000,483 A 12/1999 Jurewicz et al.
6,006,846 A 12/1999 Tibbitts
6,019,434 A 2/2000 Emmerich
6,044,920 A 4/2000 Massa
6,051,079 A 4/2000 Andersson et al.
6,056,911 A 5/2000 Griffin
6,059,373 A 5/2000 Wright et al.
6,065,552 A 5/2000 Scott et al.
6,068,072 A 5/2000 Besson et al.
6,086,160 A 7/2000 Bitelli
6,099,081 A 8/2000 Warren et al.
6,102,486 A 8/2000 Briese
6,109,377 A 8/2000 Massa et al.
6,113,195 A 9/2000 Mercier
6,131,675 A 10/2000 Anderson
6,170,917 B1 1/2001 Heinrich
6,193,770 B1 2/2001 Sung
6,196,636 B1 3/2001 Mills
6,196,910 B1 3/2001 Johnson
6,199,645 B1 3/2001 Anderson et al.
6,199,956 B1 3/2001 Kammerer
6,202,761 B1 3/2001 Forney
6,213,226 B1 4/2001 Eppink et al.
6,216,805 B1 4/2001 Lays
6,223,824 B1 5/2001 Moyes
6,241,035 B1 6/2001 Portwood
6,269,893 B1 8/2001 Beaton et al.
6,270,165 B1 8/2001 Peay
6,331,035 B1 12/2001 Montgomery, Jr.
6,332,503 B1 12/2001 Pessier et al.
6,340,064 B2 1/2002 Fielder et al.
6,341,823 B1 1/2002 Sollami
6,354,771 B1 3/2002 Bauschulte
6,357,832 B1 3/2002 Sollami
6,364,034 B1 4/2002 Schoeffler
6,364,420 B1 4/2002 Sollami
6,371,567 B1 4/2002 Sollami
6,375,272 B1 4/2002 Ojanen
6,394,200 B1 5/2002 Watson et al.
6,397,652 B1 6/2002 Sollami
6,408,959 B2 6/2002 Bertagnolli et al.
6,412,163 B1 7/2002 Russell
6,419,278 B1 7/2002 Cunningham
6,439,326 B1 8/2002 Huang et al.
6,460,637 B1 10/2002 Siracki et al.
6,474,425 B1 11/2002 Truax et al.
6,478,383 B1 11/2002 Ojanen
6,481,803 B2 11/2002 Ritchey
6,484,826 B1 11/2002 Anderson et al.
6,499,547 B2 12/2002 Scott
6,508,516 B1 1/2003 Kammerer
6,510,906 B1 1/2003 Richert et al.
6,513,606 B1 2/2003 Krueger
6,517,902 B2 2/2003 Drake
6,533,050 B2 3/2003 Molloy
RE38,151 E 6/2003 Penkunas et al.
6,585,326 B2 7/2003 Sollami
6,585,327 B2 7/2003 Sollami
6,594,881 B2 7/2003 Tibbitts
6,601,454 B1 8/2003 Botnan
6,601,662 B2 8/2003 Matthias et al.
6,622,803 B2 9/2003 Harvey
6,644,755 B1 11/2003 Kammerer
6,651,758 B2 11/2003 Xiang et al.
6,659,206 B2 12/2003 Liang et al.
6,668,949 B1 12/2003 Rives
6,672,406 B2 1/2004 Beuershausen
6,685,273 B1 2/2004 Sollami
6,692,083 B2 2/2004 Latham
6,702,393 B2 3/2004 Mercier
6,709,065 B2 3/2004 Peay
6,719,074 B2 4/2004 Tsuda
6,729,420 B2 5/2004 Mensa-Wilmot
6,732,817 B2 5/2004 Dewey et al.
6,732,914 B2 5/2004 Cadden et al.
6,733,087 B2 * 5/2004 Hall et al. ..... 299/113
6,739,327 B2 5/2004 Sollami
6,758,530 B2 7/2004 Sollami
6,786,557 B2 9/2004 Montgomery, Jr.
6,822,579 B2 11/2004 Goswami et al.
6,824,225 B2 11/2004 Stiffler
6,846,045 B2 1/2005 Sollami
6,851,758 B2 2/2005 Beach
6,854,810 B2 2/2005 Montgomery, Jr.
6,861,137 B2 3/2005 Griffin et al.
6,863,352 B2 3/2005 Sollami
6,880,744 B2 4/2005 Noro et al.
6,889,890 B2 5/2005 Yamazaki
6,918,636 B2 7/2005 Dawood
6,929,076 B2 8/2005 Fanuel et al.
6,938,961 B2 9/2005 Broom
6,953,096 B2 10/2005 Gledhill et al.
6,962,395 B2 11/2005 Mouthaan
6,966,611 B1 11/2005 Sollami

| | | | | |
|---|---|---|---|---|
| 6,994,404 | B1 | 2/2006 | Sollami | |
| 7,094,473 | B2 | 8/2006 | Takayama et al. | |
| 7,097,258 | B2 | 8/2006 | Sollami | |
| 7,118,181 | B2 | 10/2006 | Frear | |
| 7,172,256 | B2 | 2/2007 | Sleep et al. | |
| 7,204,560 | B2 | 4/2007 | Mercier | |
| 7,234,782 | B2 | 6/2007 | Stehney | |
| D560,699 | S | 1/2008 | Omi | |
| 7,320,505 | B1 * | 1/2008 | Hall et al. | 299/105 |
| 7,343,947 | B1 | 3/2008 | Sollami | |
| 7,369,743 | B2 | 5/2008 | Watkins et al. | |
| 7,380,888 | B2 | 6/2008 | Ojanen | |
| 7,384,105 | B2 | 6/2008 | Hall et al. | |
| 7,387,345 | B2 | 6/2008 | Hall et al. | |
| 7,390,066 | B2 | 6/2008 | Hall et al. | |
| 7,413,258 | B2 | 8/2008 | Hall et al. | |
| 7,445,294 | B2 | 11/2008 | Hall et al. | |
| 7,464,993 | B2 | 12/2008 | Hall et al. | |
| 7,669,938 | B2 | 3/2010 | Hall et al. | |
| 7,992,944 | B2 | 8/2011 | Hall et al. | |
| 2001/0004946 | A1 | 6/2001 | Jensen | |
| 2001/0040053 | A1 | 11/2001 | Beuershausen | |
| 2002/0034631 | A1 | 3/2002 | Griffin et al. | |
| 2002/0070602 | A1 | 6/2002 | Sollami | |
| 2002/0074851 | A1 | 6/2002 | Montgomery, Jr. | |
| 2002/0153175 | A1 | 10/2002 | Ojanen | |
| 2002/0175555 | A1 | 11/2002 | Mercier | |
| 2003/0015907 | A1 | 1/2003 | Sollami | |
| 2003/0047985 | A1 | 3/2003 | Stiffler | |
| 2003/0052530 | A1 | 3/2003 | Sollami | |
| 2003/0110667 | A1 | 6/2003 | Adachi | |
| 2003/0137185 | A1 | 7/2003 | Sollami | |
| 2003/0140360 | A1 | 7/2003 | Mansuy et al. | |
| 2003/0141350 | A1 | 7/2003 | Noro et al. | |
| 2003/0141753 | A1 | 7/2003 | Peay et al. | |
| 2003/0209366 | A1 | 11/2003 | McAlvain | |
| 2003/0213354 | A1 | 11/2003 | Frers | |
| 2003/0213621 | A1 | 11/2003 | Britten | |
| 2003/0230926 | A1 | 12/2003 | Mondy et al. | |
| 2003/0234280 | A1 | 12/2003 | Cadden et al. | |
| 2004/0026132 | A1 | 2/2004 | Hall et al. | |
| 2004/0026983 | A1 | 2/2004 | McAlvain | |
| 2004/0065484 | A1 | 4/2004 | McAlvain | |
| 2004/0228694 | A1 | 11/2004 | Webb et al. | |
| 2004/0238221 | A1 | 12/2004 | Runia et al. | |
| 2004/0256155 | A1 | 12/2004 | Kriesels | |
| 2005/0035649 | A1 | 2/2005 | Mercier | |
| 2005/0044987 | A1 | 3/2005 | Takayama et al. | |
| 2005/0159840 | A1 | 7/2005 | Lin et al. | |
| 2005/0173966 | A1 | 8/2005 | Mouthaan | |
| 2006/0006727 | A1 | 1/2006 | Frear | |
| 2006/0086537 | A1 | 4/2006 | Dennis | |
| 2006/0086540 | A1 | 4/2006 | Griffin | |
| 2006/0125306 | A1 | 6/2006 | Sollami | |
| 2006/0186724 | A1 | 8/2006 | Stehney | |
| 2006/0237236 | A1 | 10/2006 | Sreshta | |
| 2006/0261663 | A1 | 11/2006 | Sollami | |
| 2007/0013224 | A1 | 1/2007 | Stehney | |
| 2008/0084106 | A1 * | 4/2008 | Marathe et al. | 299/110 |

FOREIGN PATENT DOCUMENTS

| | | | |
|---|---|---|---|
| DE | 3500261 | | 7/1986 |
| DE | 3818213 | | 11/1989 |
| DE | 4039217 | | 6/1992 |
| DE | 19821147 | | 11/1999 |
| DE | 10163717 | | 5/2003 |
| EP | 0295151 | | 12/1988 |
| EP | 0412287 | | 2/1991 |
| EP | 0 899 051 | A1 | 3/1999 |
| EP | 1 574 309 | | 9/2005 |
| GB | 2004315 | | 3/1979 |
| GB | 2037223 | | 11/1979 |
| GB | 2 423 319 | A | 8/2006 |
| JP | 5280273 | A | 10/1993 |
| JP | 2000-052108 | A | 2/2000 |
| JP | 2002-081524 | | 3/2002 |
| RU | 2 079 651 | | 5/1997 |

OTHER PUBLICATIONS

Hoch, Jeffrey G., Is There Room for Geothermal Energy, Innovation: America's Journal of Tech Communication http://www.innovation-america.org/, Dec. 2006-Jan. 2007.

US Dept. of Energy, Geothermal Drilling Faster & Cheaper is Better, Geothermal Today, p. 28, National Renewal Energy Laboratory Golden, Colorado, May 2000.

Glowka, David A., et al., Progress in the Advanced Synthetic-Diamond Drill Bit Program, 1995.

Taylor, Mark A., The State of Geothermal Technology Part 1: Subsurface Technology, pp. 29-30, Geothermal Energy Association, Washington, D.C., Nov. 2007.

Durrand, Christopher J., Super-hard, Thick Shaped PDC Cutters for Hard Rock Drilling: Development & Test Results, Geothermal Reservoir Engineering, Stanford, California, Feb. 3, 2010.

Jennejohn, Dan, Research & Development in Geothermal Exploration & Drilling, pp. 15, 18-19, Geothermal Energy Association, Washington, D.C., Dec. 1, 2009.

International Search Report for PCT/US08/69231, Nov. 18, 2008.

Written Opinion for PCT/US08/69231, Nov. 18, 2008.

International Preliminary Report on Patentability for PCT/US08/69231, Jan. 5, 2010.

* cited by examiner

SHANK FOR AN ATTACK TOOL

CROSS REFERENCE IS RELATED APPLICATIONS

This application is a continuation-in-part of U.S. patent application Ser. No. 11/463,990, which was filed on Aug. 11, 2006 and is now U.S. Pat. No. 7,320,050. U.S. patent application Ser. No. 11/463,990 is a continuation-in-part of U.S. patent application Ser. No. 11/463,975 which was filed on Aug. 11, 2006 and entitled An Attack Tool and is now U.S. Pat. No. 7,445,294. U.S. patent application Ser. No. 11/463,975 is a continuation-in-part of U.S. patent application Ser. No. 11/463,962 which was filed on Aug. 11, 2006 and entitled An Attack Tool and is now U.S. Pat. No. 7,413,256. All of these applications and now patents are herein incorporated by reference for all that it contains.

BACKGROUND OF THE INVENTION

Formation degradation, such as asphalt milling, mining, or excavating, may result in wear on attack tools. Consequently, many efforts have been made to extend the life of these tools. Examples of such efforts are disclosed in U.S. Pat. No. 4,944,559 to Sionnet et at, U.S. Pat. No. 5,837,071 to Andersson et al., U.S. Pat. No. 5,417,475 to Graham et al., U.S. Pat. No. 6.051,079 to Andersson et al., and U.S. Pat. No. 4,725,098 to Beach, all of which are herein incorporated by reference for all that they disclose.

BRIEF SUMMARY OF THE INVENTION

In one aspect of the invention, an attack tool is disclosed which comprises a wear-resistant base suitable for attachment to a driving mechanism. The wear-resistant base has a shank. A cemented metal carbide segment is bonded to the base and the shank has a wear-resistant surface. The wear-resistant surface has a hardness greater than 60 HRc and/or is work hardened.

In this disclosure, the abbreviation "HRc" stands for the Rockwell Hardness "C" scale, and the abbreviation "HK" stands for Knoop Hardness.

DETAILED DESCRIPTION OF THE INVENTION AND THE PREFERRED EMBODIMENT

It will be readily understood that the components of the present invention, as generally described and illustrated in the Figures herein, may be arranged and designed in a wide variety of different configurations. Thus, the following more detailed description of embodiments of the methods of the present invention, as represented in the Figures is not intended to limit the scope of the invention, as claimed, but is merely representative of various selected embodiments of the invention.

The illustrated embodiments of the invention will best be understood by reference to the drawings, wherein like parts are designated by like numerals throughout. Those of ordinary skill in the art will, of course, appreciate that various modifications to the methods described herein may easily be made without departing from the essential characteristics of the invention, as described in connection with the Figures. Thus, the following description of the Figures is intended only by way of example, and simply illustrates certain selected embodiments.

Figure 1:
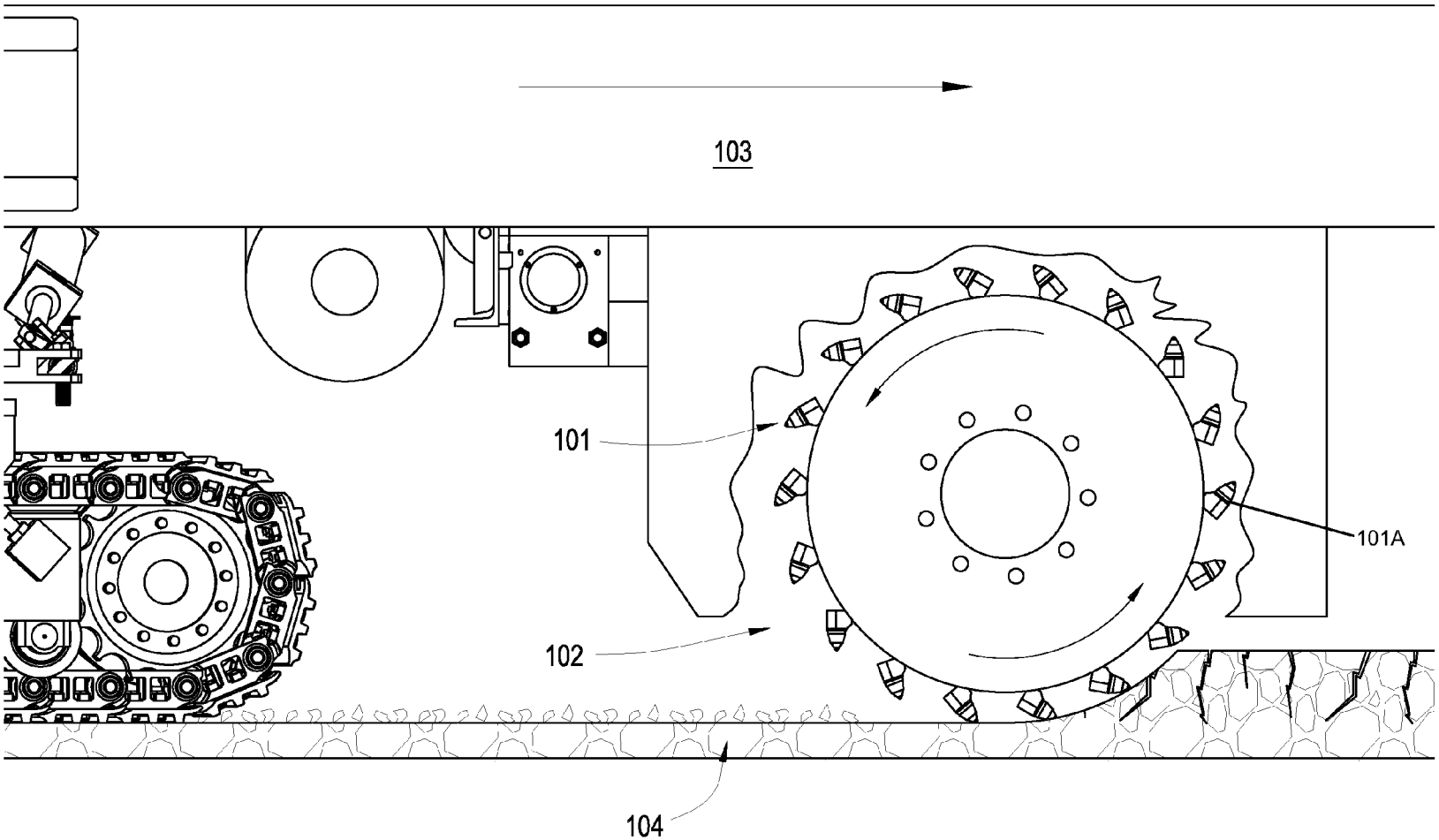
FIG. 1 is a cross-sectional diagram of an embodiment of attack tools on a rotating drum attached to a motor vehicle.

FIG. 1 is a cross-sectional diagram of an embodiment of an attack tool 101 on a rotating drum 102 attached to a motor vehicle 103. The motor vehicle 103 may be a cold planer used to degrade man-made formations such as pavement 104 prior to the placement of a new layer of pavement, a mining vehicle used to degrade natural formations, or an excavating machine. Tools 101 A may be attached to a drum 102 or a chain which rotates so the tools 101 A engage a formation. The formation that the attack tool 101 engages may be hard and/or abrasive and cause substantial wear on tools 101 A. The wear-resistant tool 101 A may be selected from the group consisting of drill bits, asphalt picks, mining picks, hammers, indenters, shear cutters, indexable cutters, and combinations thereof. In large operations, such as pavement degradation or mining, when tools 101 A need to be replaced the entire operation may cease while crews remove worn tools 101 A and replace them with new tools 101 A. The time spent replacing tools may be costly.

Figure 2:
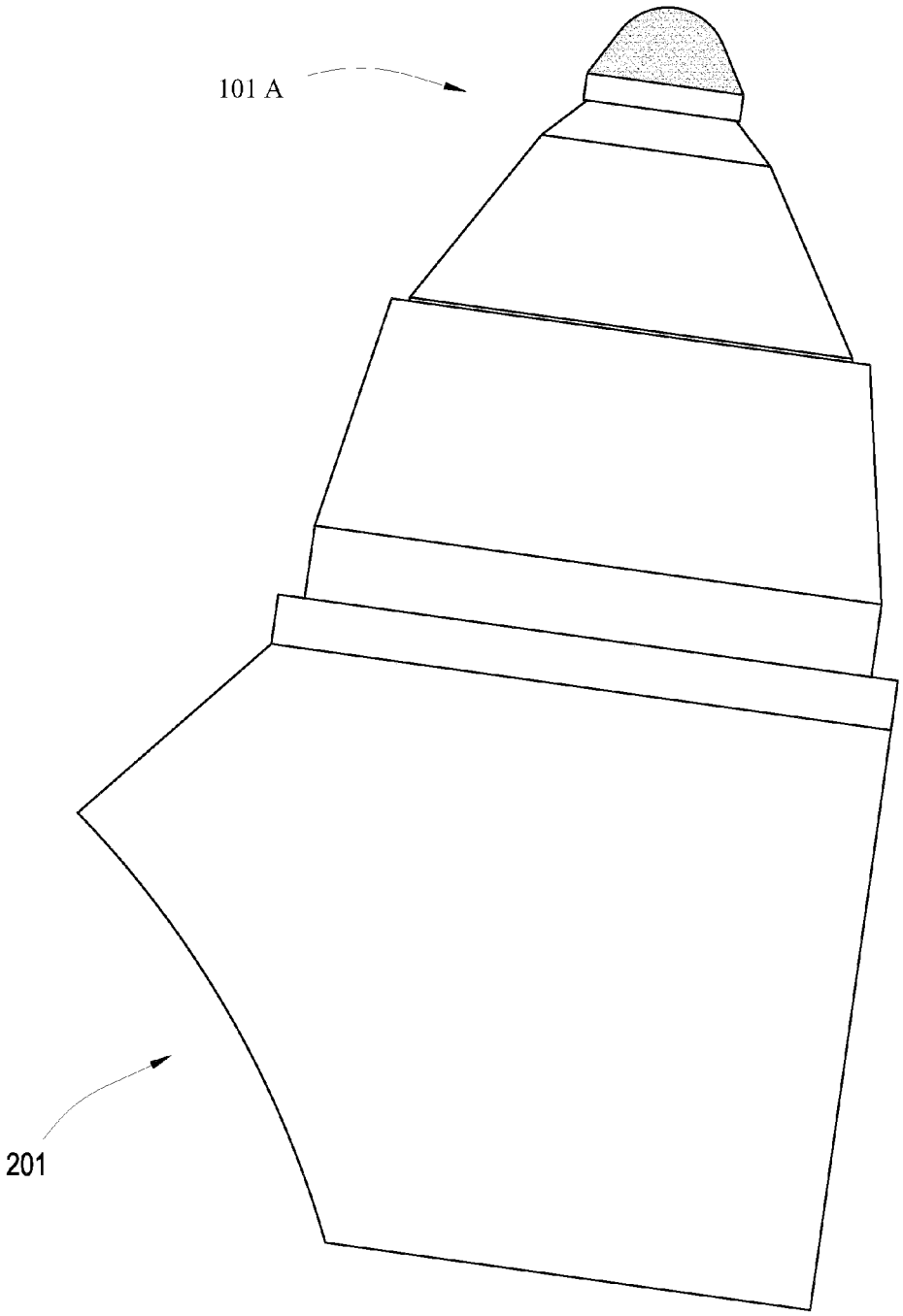
FIG. 2 is an orthogonal diagram of an embodiment of an attack tool and a holder.

FIG. 2 is an orthogonal (i.e., planar) diagram of a tool 101 A and a tool holder 201. A tool 101 A/holder 201 combination is often used in asphalt milling and mining. A holder 201 is attached to a driving mechanism, which may be a rotating drum 102. The tool 101 A is inserted into the holder 201. The holder 201 may hold the tool 101 A at an angle offset from the direction of rotation, such that the tool 101 A optimally engages a formation.

Figure 3:
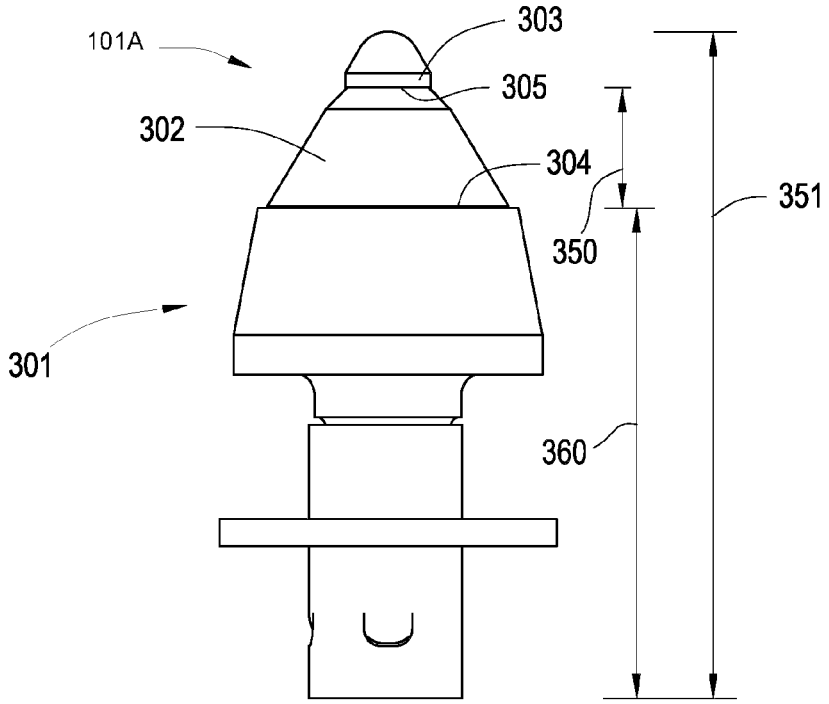
FIG. 3 is an orthogonal diagram of another embodiment of an attack tool.

FIG. 3 is an orthogonal diagram of an embodiment of a tool 101 A with a first cemented metal carbide segment with a first volume. The tool 101 A comprises a base 301 suitable for attachment to a driving mechanism. A first cemented metal carbide segment 302 is bonded to the base 301 at a first interface 304; and a second metal carbide segment 303 is bonded to the first carbide segment 302 at a second interface 305 opposite the base 301. The first cemented metal carbide segment 302 may comprise a first volume of 0.100 cubic inches to 2 cubic inches. Such a volume may be beneficial in absorbing impact stresses and protecting the rest of the tool 101 A from wear. The first and/or second interfaces 304, 305 may be planar as well. The first and/or second metal carbide segments 302, 303 may comprise tungsten, titanium, tantalum, molybdenum, niobium, cobalt and/or combinations thereof.

Further, the tool 101 A may comprise a ratio of the length 350 of the first cemented metal carbide segment 302 to the length of the whole attack tool 351 which is 1/10 to 1/2; preferably the ratio is 1/7 to 1/2.5. The wear-resistant base 301 may have a length 360 that is at least half of the tool's length 351.

Figure 4:
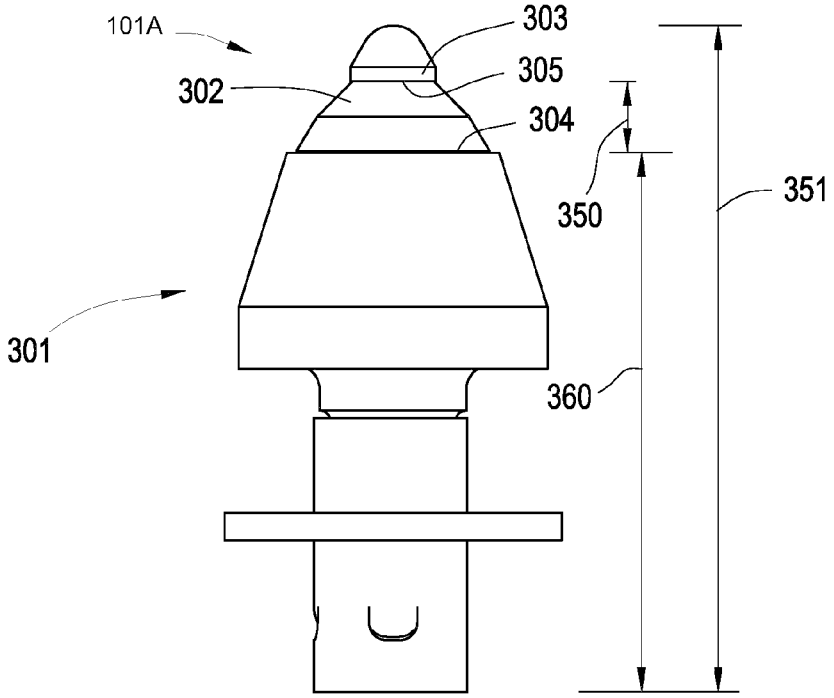
FIG. 4 is an orthogonal diagram of another embodiment of an attack tool.

FIG. 4 is an orthogonal diagram of an embodiment of a tool with a first cemented metal carbide segment with a second volume, which is less than the first volume. This may help to reduce the weight of the tool 101 A which may require less horsepower to move or it may help to reduce the cost of the attack tool.

Figure 5:
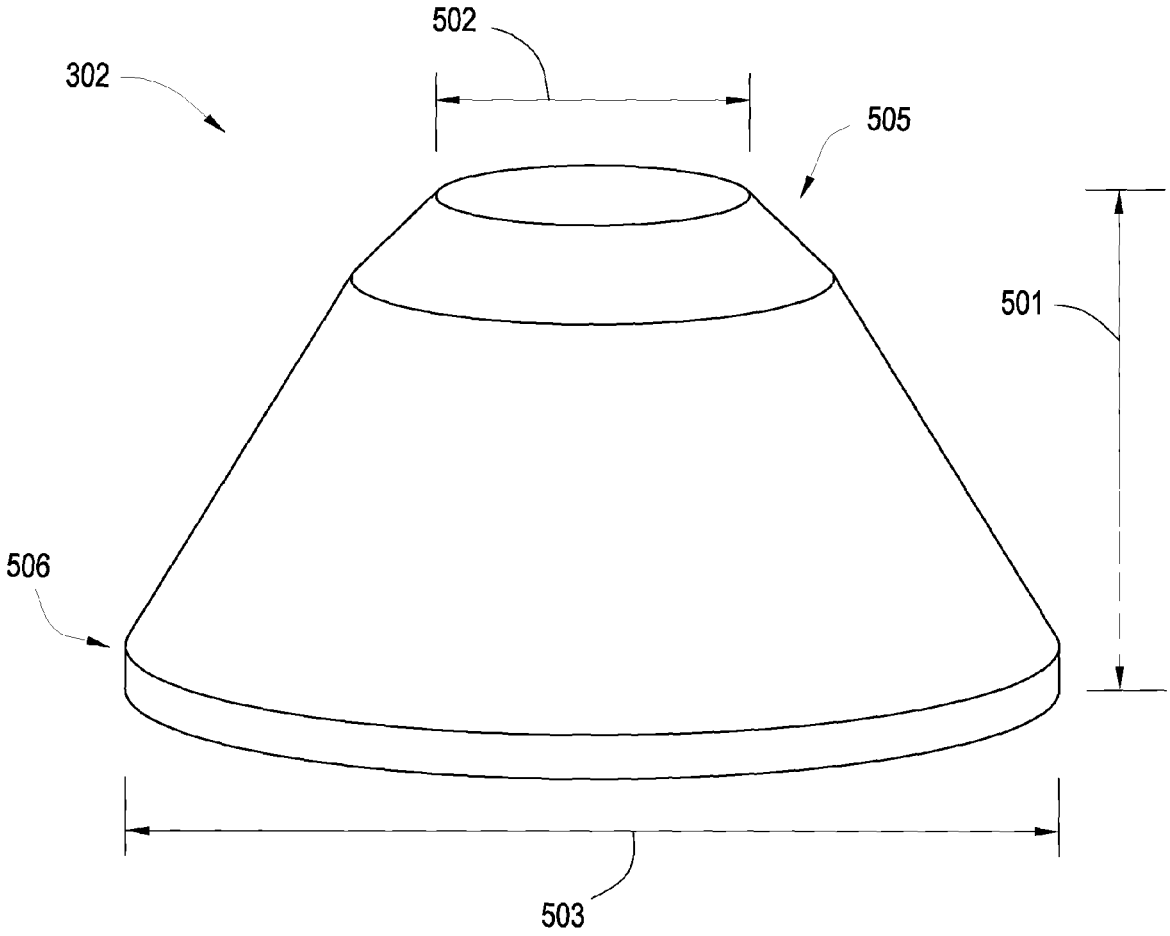
FIG. 5 is a perspective diagram of a first cemented metal carbide segment.

FIG. 5 is a perspective diagram of a first cemented metal carbide segment. The volume of the first segment 302 may be 0.100 to 2 cubic inches; preferably the volume may be 0.350 to 0.550 cubic inches. The first segment 302 may comprise a height 501 of 0.2 inches to 2 inches; preferably the height 501 may be 0.500 inches to 0.800 inches. The first segment 302 may comprise an upper cross-sectional thickness 502 of 0.250 to 0.750 inches; preferably the upper cross-sectional thickness 502 may be 0.300 inches to 0.500 inches. The first segment 302 may also comprise a lower cross-sectional thickness 503 of 1 inch to 1.5 inches; preferably the lower cross-sectional thickness 503 may be 1.10 inches to 1.30 inches. The upper and lower cross-sectional thicknesses 502, 503 may be planar. The first segment 302 may also comprise a nonuniform cross-sectional thickness. Further, the segment 302 may have features such as a chamfered edge 505 and a ledge 506 to optimize bonding and/or improve performance.

FIGS. 6-10 are orthogonal diagrams of several embodiments 302 A-E of a first cemented metal carbide segment. Each figure discloses planar upper and lower ends 601 A-E, 602 A-E. When the ends 601 A-E, 602 A-E are bonded to the base 301 and second segment 303, the resulting interfaces 304, 305 may also be planar. In other embodiments, the ends comprise a non-planar geometry such as a concave portion, a convex portion, ribs, splines, recesses, protrusions, and/or combinations thereof.

Figure 6:
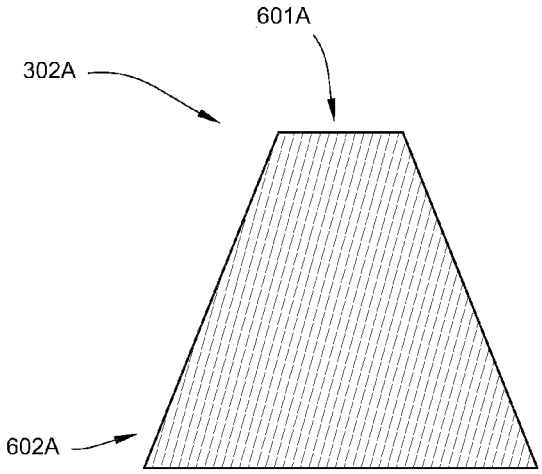
FIG. 6 is an orthogonal diagram of an embodiment of a first cemented metal carbide segment.
Figure 7:
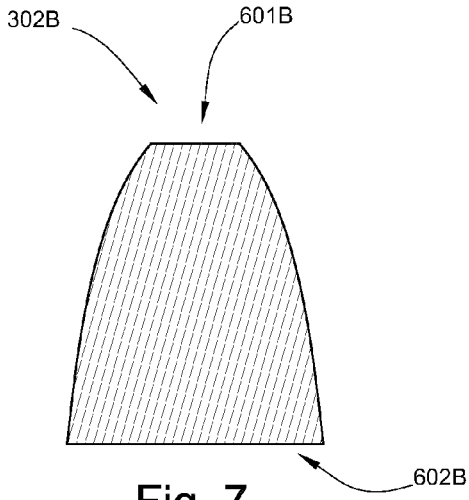
FIG. 7 is an orthogonal diagram of another embodiment of a first cemented metal carbide segment.
Figure 8:
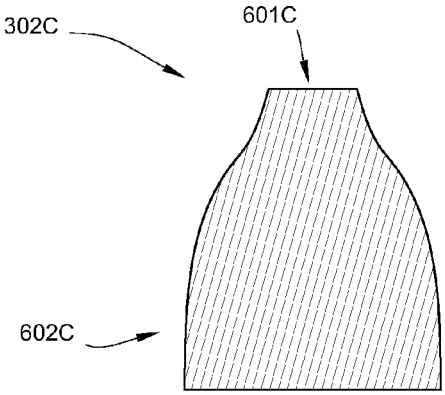
FIG. 8 is an orthogonal diagram of another embodiment of a first cemented metal carbide segment.
Figure 9:
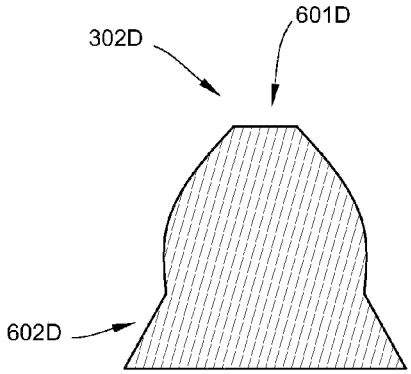
FIG. 9 is an orthogonal diagram of another embodiment of a first cemented metal carbide segment.
Figure 10:
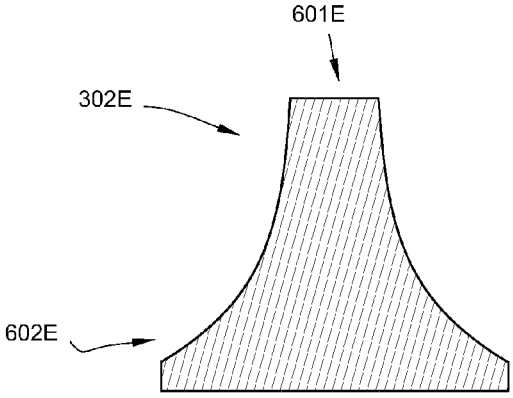
FIG. 10 is an orthogonal diagram of another embodiment of a first cemented metal carbide segment.

The first segment 302 A-E may comprise various geometries. The geometry may be optimized to move cuttings away from the tool 101, distribute impact stresses, reduce wear, improve degradation rates, protect other parts of the tool 101 A, and/or combinations thereof. The embodiments of FIGS. 6 and 7, for instance, may be useful for protecting the tool 101 A. FIG. 6 comprises an embodiment of the first segment 302 A without features such as a chamfered edge 505 and a ledge 506. The bulbous geometry of the first segment 302 C and D in FIGS. 8 and 9 may be sacrificial and may extend the life of the tool 101 A. A segment 302 E as disclosed in FIG. 10 may be useful in moving cuttings away from the tool 101 and focusing cutting forces at a specific point.

FIGS. 11-16 are cross-sectional diagrams of several embodiments 1151 A-F of a second cemented metal carbide segment and a superhard material. The second cemented metal carbide segment 303 A-F may be bonded to a superhard material 306 A-F opposite the interface 304 (FIG. 3) between the first segment 302 and the base 301. In other embodiments, the superhard material is bonded to any portion of the second segment. The interface 1150 A-F between the second segment 303 A-F and the superhard material 306 A-F may be non-planar or planar. The superhard material 306 A-F may comprise polycrystalline diamond, vapor-deposited diamond, natural diamond, cubic boron nitride, infiltrated diamond, layered diamond, diamond impregnated carbide, diamond impregnated matrix, silicon bonded diamond, or combinations thereof. The superhard material may be at least 4,000 HK and in some embodiments it may be 1 to 20000 microns thick. In embodiments, where the superhard material is a ceramic, the material may comprise a region 1160 (preferably near its surface 1151) that is free of binder material. The average grain size of a superhard ceramic may be 10 to 100 microns in size. Infiltrated diamond is typical made by sintering the superhard material adjacent a cemented metal carbide and allowing a metal (such as cobalt) to infiltrate into the superhard material. The superhard material may be a synthetic diamond comprising a binder concentration of 4 to 35 weight percent.

Figure 11:
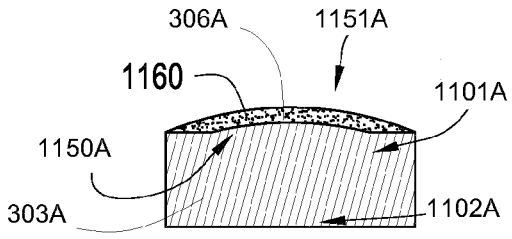
FIG. 11 is a cross-sectional diagram of an embodiment of a second cemented metal carbide segment and a superhard material.
Figure 12:
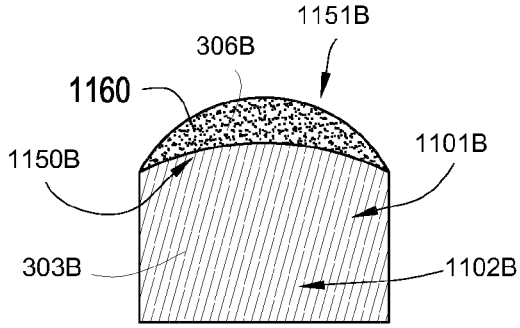
FIG. 12 is a cross-sectional diagram of another embodiment of a second cemented metal carbide segment and a superhard material.
Figure 13:
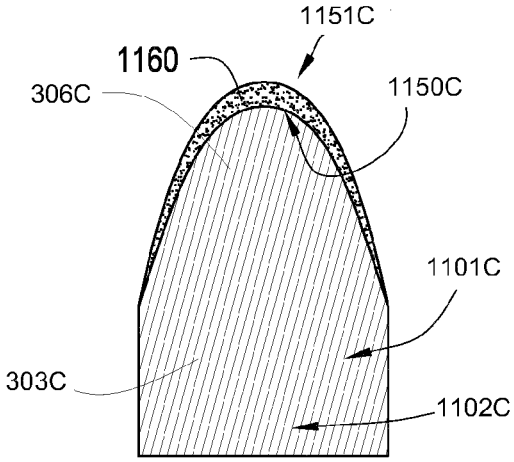
FIG. 13 is a cross-sectional diagram of another embodiment of a second cemented metal carbide segment and a superhard material.
Figure 14:
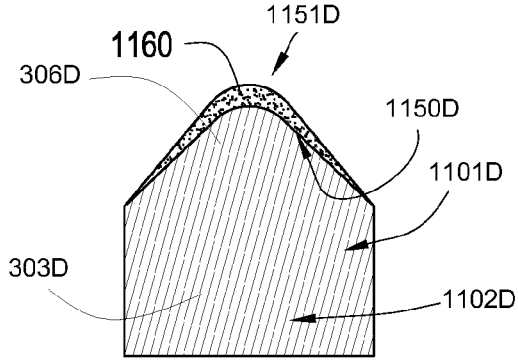
FIG. 14 is a cross-sectional diagram of another embodiment of a second cemented metal carbide segment and a superhard material.
Figure 15:
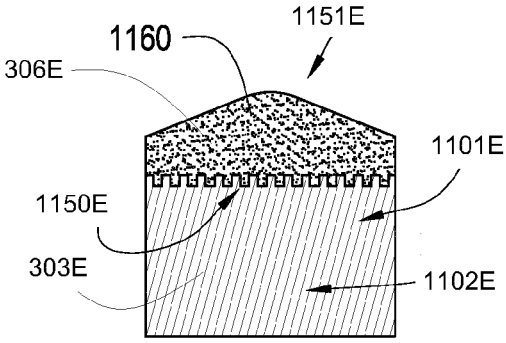
FIG. 15 is a cross-sectional diagram of another embodiment of a second cemented metal carbide segment and a superhard material.
Figure 16:
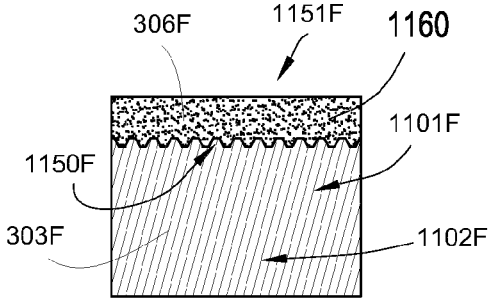
FIG. 16 is a cross-sectional diagram of another embodiment of a second cemented metal carbide segment and a superhard material.

The second segment 303 A-F and superhard material may comprise many geometries. In FIG. 11 the second segment 303 A has a relatively small surface area to bind with the superhard material reducing the amount of superhard material required and reducing the overall cost of the attack tool. In embodiments, where the superhard material is a polycrystalline diamond, the smaller the second carbide segment the cheaper it may be to produce large volumes of attack tool since more second segments may be placed in a high temperature high pressure apparatus at once. The superhard material 306 A in FIG. 11 comprises a semi-round geometry. The superhard material in FIG. 12 comprises a domed geometry. The superhard material 306 C in FIG. 13 comprises a mix of domed and conical geometry. Blunt geometries, such as those disclosed in FIGS. 11-13 may help to distribute impact stresses during formation degradation, but cutting efficiency may be reduced. The superhard material 306 A in FIG. 14 comprises a conical geometry. The superhard material 306 E in FIG. 15 comprises a modified conical geometry; and the superhard material 306 F in FIG. 16 comprises a flat geometry. Sharper geometries, such as those disclosed in FIGS. 14 and 15, may increase cutting efficiency, but more stress may be concentrated to a single point of the geometry upon impact. A flat geometry may have various benefits when placed at a positive cutting rake angle or other benefits when placed at a negative cutting rake angle.

The second segment 303 A-F may comprise a region 1102 A-F proximate the second interface 305 (FIG. 3) which may comprise a higher concentration of a binder than a distal region 1101 A-F of the second segment 303 A-F to improve bonding or add elasticity to the tool. The binder may comprise cobalt, iron, nickel, ruthenium, rhodium, palladium, chromium, manganese, tantalum, or combinations thereof.

Figure 17:
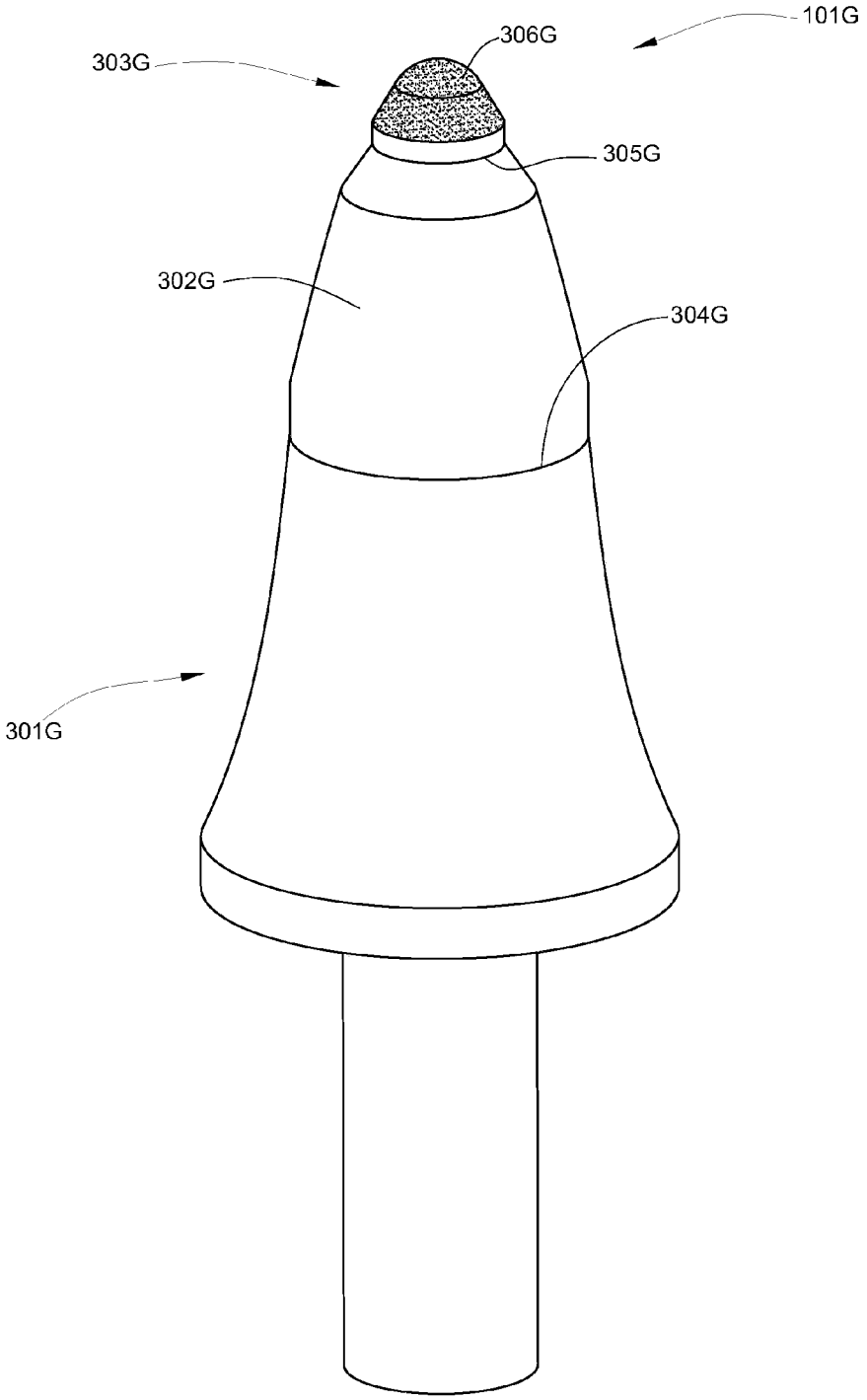
FIG. 17 is a perspective diagram of another embodiment of an attack tool.

FIG. 17 is a perspective diagram of another embodiment of a tool. Such a tool 101 G may be used in mining. Mining equipment, such as continuous miners, may use a driving mechanism to which tools 101 G may be attached. The driving mechanism may be a rotating drum similar to drum 102 (FIG. 1) used in asphalt milling, which may cause the tools 101 G to engage a formation, such as a vein of coal or other natural resources. Tools 101 G used in mining may be elongated compared to similar tools 101 A (FIG. 1) like picks used in asphalt cold planers.

Figure 18:
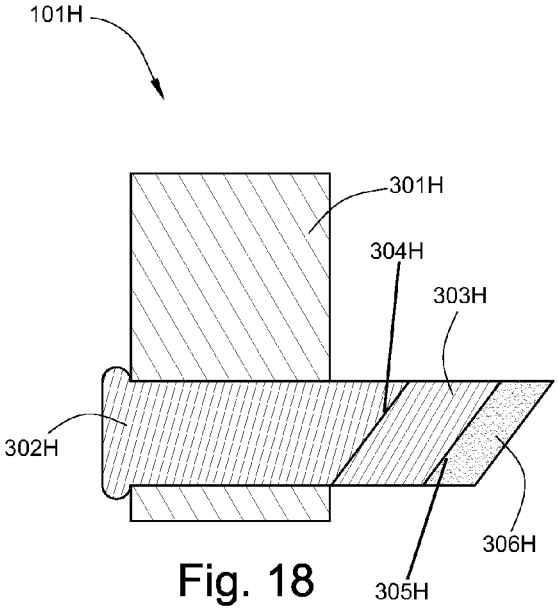
FIG. 18 is an orthogonal diagram of an alternate embodiment of an attack tool.
Figure 19:
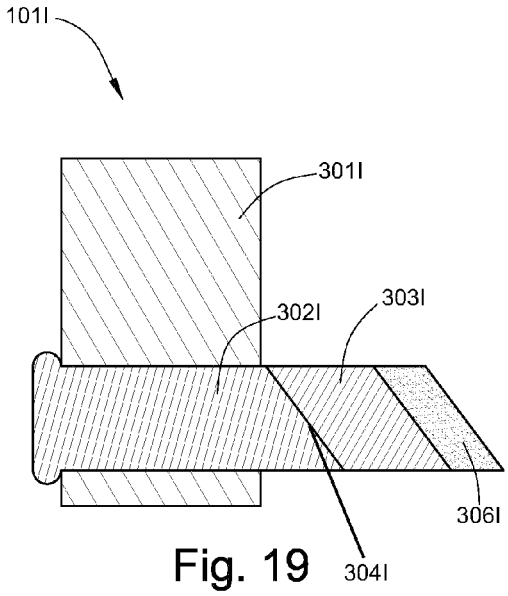
FIG. 19 is an orthogonal diagram of another alternate embodiment of an attack tool.
Figure 20:
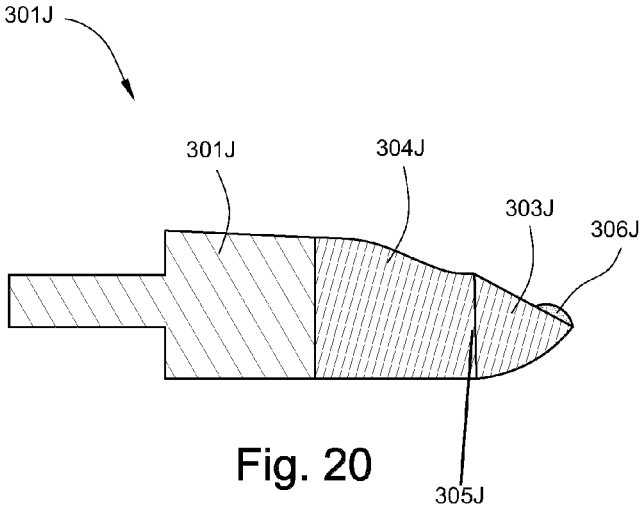
FIG. 20 is an orthogonal diagram of another alternate embodiment of an attack tool.

FIGS. 18-20 are cross-sectional diagrams of alternate embodiments of an attack tool 101 H-J. These tools are adapted to remain stationary within a holder like the holder 201 attached to the driving mechanism. Each of the tools 101 H-J may comprise a base segment 301 H-J which may comprise steel, a cemented metal carbide, or other metal. The tools 101 H-J may also comprise first and second segments 302 H-J, 303 H-J bonded at interfaces 304 H-J, 305 H-J. The angle and geometry of the superhard material 306 H-J may be altered to change the cutting ability of the tool 101 H-J. Positive or negative rake angles may be used along with geometries that are semi-rounded, rounded, domed, conical, blunt, sharp, scoop, or combinations thereof. Also the superhard material may be flush with the surface of the carbide or it may extend beyond the carbide as well.

Figure 21:
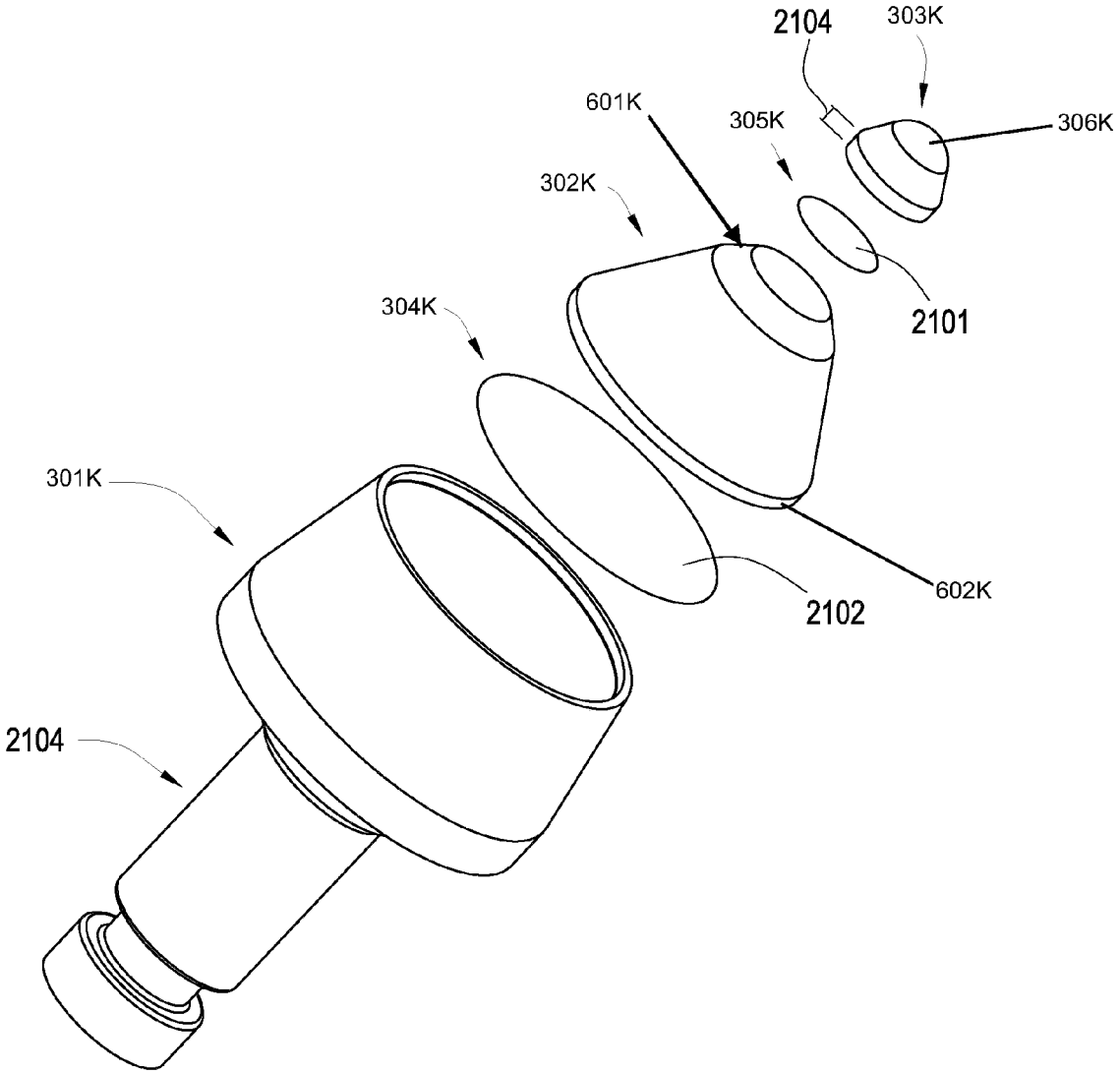
FIG. 21 is an exploded perspective diagram of another embodiment of an attack tool.

FIG. 21 is an exploded perspective diagram of an embodiment of an attack tool. The tool 101 K comprises a wear-resistant base 301 K suitable for attachment to a driving mechanism. The tool 101 K also has a first cemented metal carbide segment 302 K brazed to the wear-resistant base at a first interface 304 K, a second cemented metal carbide segment 303 K brazed to the first cemented metal carbide segment 302 K at a second interface 305 K opposite the wear-resistant base 301 K, a shank 2104, and a braze material 2101 disposed in the second interface 305 K. The braze material 2101 has 30 to 62 weight percent of palladium. Preferably, the braze material comprises 40 to 50 percent of palladium by weight.

The braze material 2101 may have a melting temperature from 700 to 1200 degrees Celsius; and preferably the melting temperature is from 800 to 970 degrees Celsius. The braze material may comprise silver, gold, copper nickel, palladium, boron, chromium, silicon, germanium, aluminum, iron, cobalt, manganese, titanium, tin, gallium, vanadium, phosphorus, molybdenum, platinum, or combinations thereof. The braze material 2101 may comprise 30 to 60 weight percent nickel, 30 to 62 weight percent palladium, and 3 to 15 weight percent silicon; preferably the first braze material 2101 may comprise 47.2 weight percent nickel, 46.7 weight percent palladium, and 6.1 weight percent silicon. Active cooling during brazing may be critical in some embodiments, since the heat from brazing may leave some residual stress in the bond between the second carbide segment and the superhard material. The second carbide segment 303 K may comprise a length of 0.1 to 2 inches. The superhard material 306 K may be 0.020 to 0.100 inches away from the interface 305 K. The further away the superhard material 306 K is, the less thermal damage is likely to occur during brazing. Increasing the distance 2104 between the interface 305 K and the superhard material 306 K, however, may increase the moment on the second carbide segment and increase stresses at the interface 305 K upon impact.

The first interface 304 K may comprise a second braze material 2102 which may have a melting temperature from 800 to 1200 degrees Celsius. The second braze material 2102 may comprise 40 to 80 weight percent copper, 3 to 20 weight percent nickel, and 3 to 45 weight percent manganese; preferably the second braze material 2101 may comprise 67.5 weight percent copper, 9 weight percent nickel, and 23.5 weight percent manganese.

Further, the first cemented metal carbide segment 302 K may comprise an upper end 601 K and the second cemented metal carbide segment may have a lower end 602, wherein the upper and lower ends 601 K, 602 K are substantially equal.

Figure 22:
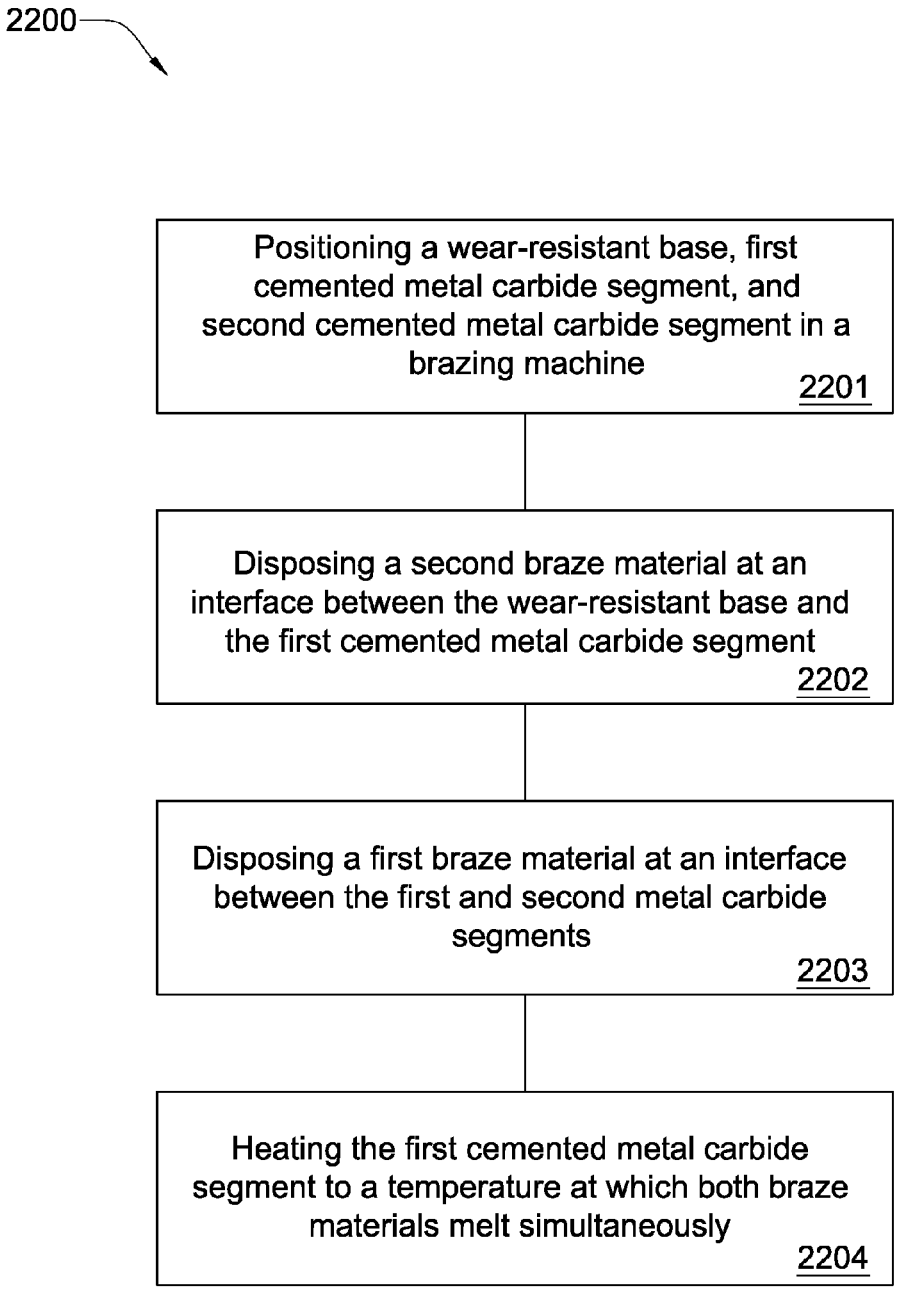
FIG. 22 is a schematic of a method of manufacturing an attack tool.

FIG. 22 is a schematic of a method of manufacturing a tool. The method 2200 comprises positioning 2201 a wear-resistant base 301, first cemented metal carbide segment 302, and second cemented metal carbide segment 303 in a brazing machine, disposing 2202 a second braze material 2102 at an interface 304 between the wear-resistant base 301 and the first cemented metal carbide segment 302, disposing 2203 a first braze material 2101 at an interface 305 between the first and second cemented metal carbide segments 302, 303, and heating 2204 the first cemented metal carbide segment 302 to a temperature at which both braze materials melt simultaneously. The method 2200 may comprise an additional step of actively cooling the attack tool, preferably the second carbide segment 303, while brazing. The method 2200 may further comprise a step of air-cooling the brazed tool 101.

The interface 304 between the wear-resistant base 301 and the first segment 302 may be planar, and the interface 305 between the first and second segments 302, 303 may also be planar. Further, the second braze material 2102 may comprise 50 to 70 weight percent of copper, and the first braze material 2101 may comprise 40 to 50 weight percent palladium.

Figure 23:
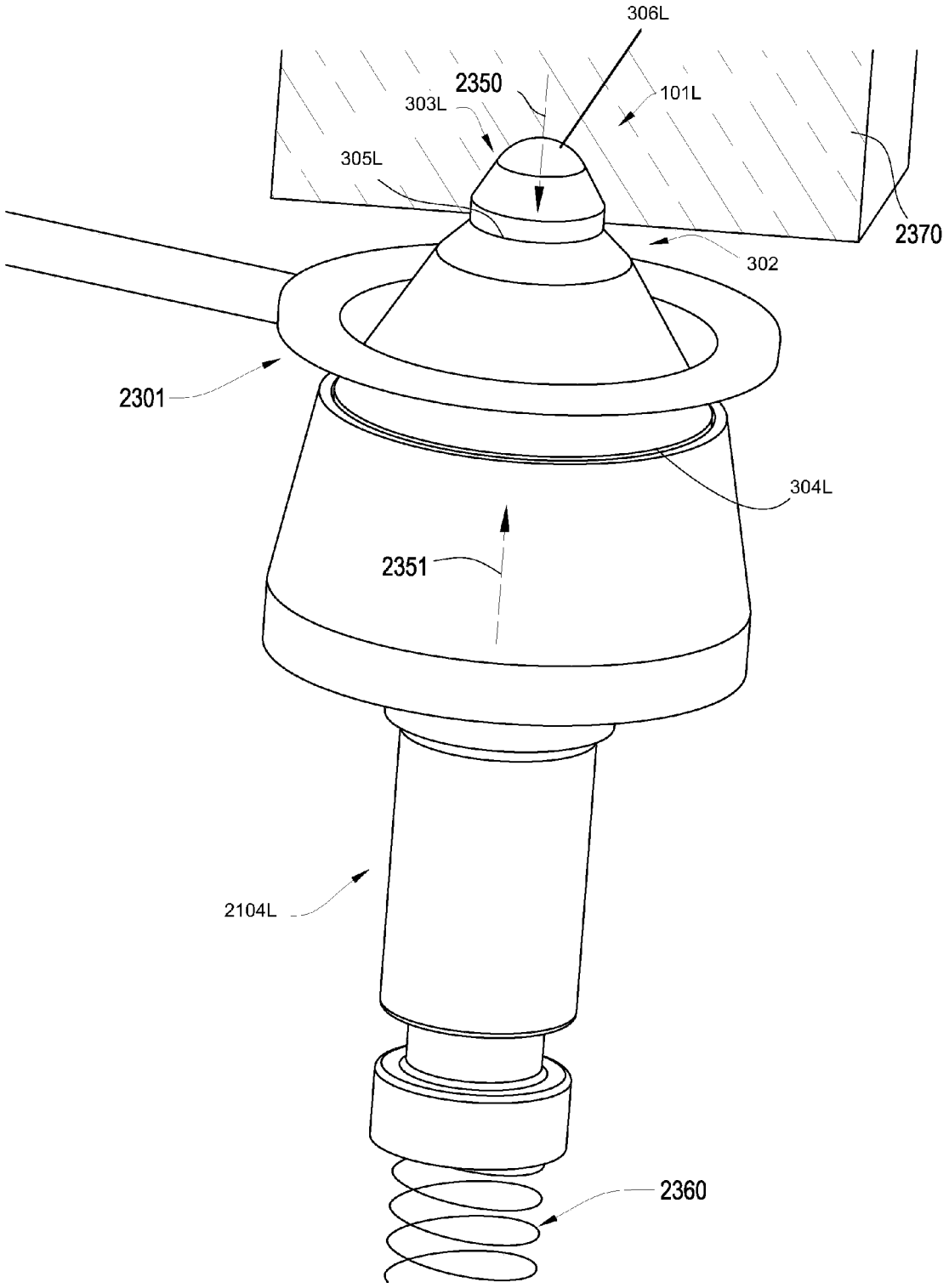
FIG. 23 is a perspective diagram of tool segments being brazed together.

FIG. 23 is a perspective diagram of tool segments being brazed together. The attack tool 101 L may be assembled as described in the above method 2200. Force, indicated by arrows 2350 and 2351, may be applied to the tool 101 L to keep all components in line. A spring 2360 may urge the shank 2104 L upwards and positioned within the machine (not shown). There are various ways to heat the first segment 302, including using an inductive coil 2301. The coil 2301 may be positioned to allow optimal heating at both interfaces 304 L, 305 L to occur. Brazing may occur in an atmosphere that is beneficial to the process. Using an inert atmosphere may eliminate elements such as oxygen, carbon, and other contaminates from the atmosphere that may contaminate the braze material.

The tool 101 L may be actively cooled as it is being brazed. Specifically, the superhard material 306 L may be actively cooled. A heat sink 2370 may be placed over at least part of the second segment 303 L to remove heat during brazing. Water or other fluid may be circulated around the heat sink 2370 to remove the heat. The heat sink 2370 may also be used to apply a force on the tool 101 L to hold it together while brazing.

Figure 24:
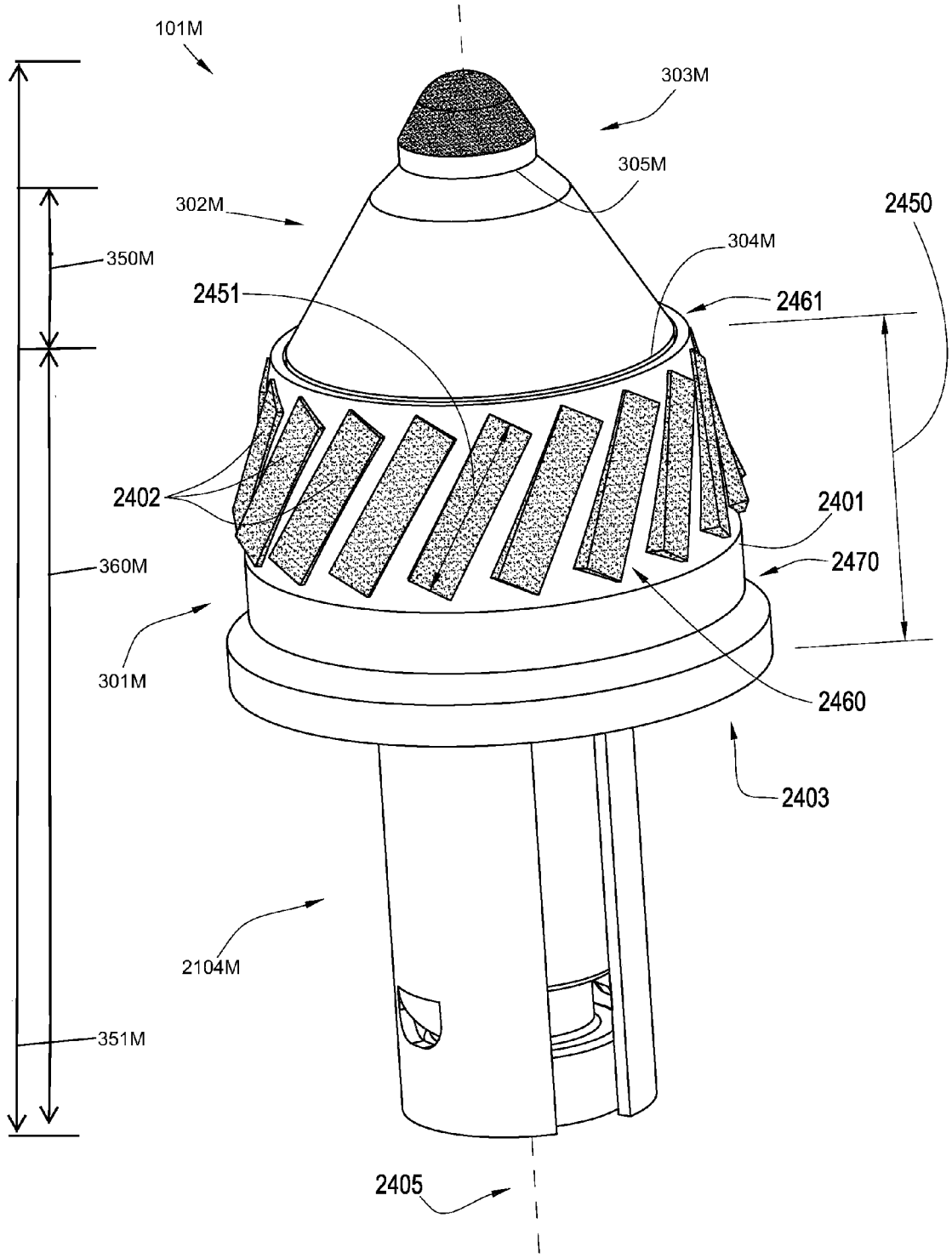
FIG. 24 is a perspective diagram of an embodiment of an attack tool with inserts bonded to the wear-resistant base.

FIG. 24 is a perspective diagram of an embodiment of a tool with inserts in the wear-resistant base. An attack tool 101 M may comprise a wear-resistant base 301 M with a carbide tip segment 303 M attached at interface 305 M and 304 M further suitable for attachment to a driving mechanism. The wear-resistant base has a shank 2104 M and a metal segment 2401 The cemented metal carbide segment 302 M bonded to the metal segment 2401 opposite the shank 2104 M; and at least one hard insert 2402 bonded to the metal segment 2401 proximate the shank wherein the insert 2402 comprises a hardness greater than 60 HRc. The metal segment 2401 may comprise a hardness of 40 to 50 HRc. The metal segment 2401 and shank 2104 may be made from the same piece of material.

The insert 2402 may comprise a material selected from the group consisting of diamond, natural diamond, polycrystalline diamond, cubic boron nitride, vapor-deposited diamond, diamond grit, polycrystalline diamond grit, cubic boron nitride grit, chromium, tungsten, titanium, molybdenum, niobium, a cemented metal carbide, tungsten carbide, aluminum oxide, zircon, silicon carbide, whisker reinforced ceramics, diamond impregnated carbide, diamond impregnated matrix, silicon bonded diamond, or combinations thereof as long as the hardness of the material is greater than 60 HRc. Having an insert 2402 that is harder than the metal segment 2401 may decrease the wear on the metal segment 2401. The insert 2402 may comprise a cross-sectional thickness of 0.030 to 0.500 inches. The insert 2402 may comprise an axial length 2451 less than an axial length 2450 of the metal segment 2402, and the insert 2402 may comprise a length shorter than a circumference 2470 of the metal segment 2401 proximate the shank 2104. The insert 2402 may be brazed to the metal segment 2401 M. The insert 2402 may be a ceramic with a binder comprising 4 to 35 weight percent of the insert. The insert 2402 may also be polished.

The base 301 M may have a ledge 2403 substantially normal to an axial length of the tool 101 M, the axial length being measured along the axis 2405 shown. At least a portion of a perimeter 2460 of the insert 2402 may be within 0.5 inches of the ledge 2403. If the ratio of the length 350 M of the first cemented metal carbide segment 302 M to the length of the whole attack tool 351 M may be 1/10 to 1/2, the wear-resistant base 301 M may comprise as much as 9/10 to 1/2 of the tool 101 M. An insert's axial length 2451 may not exceed the length of the wear-resistant base's length 360 M. The insert's perimeter 2460 may extend to the edge 2461 of the wear-resistant base 301 M, but the first carbide segment 302 M may be free of an insert 2402. The insert 2402 may be disposed entirely on the wear-resistant base 301 M. Further, the metal segment 2401 may comprise a length 2450 which is greater than the insert's length 2451; the perimeter 2460 of the insert 2402 may not extend beyond the ledge 2403 of the metal segment 2401 or beyond the edge of the metal segment 2461.

Inserts 2402 may also aid in tool rotation. Attack tools 101 M often rotate within their holders upon impact which allows wear to occur evenly around the tool 101 M. The inserts 2402 may be angled such so that it causes the tool 101 M to rotate within the bore of the holder.

Figure 25:
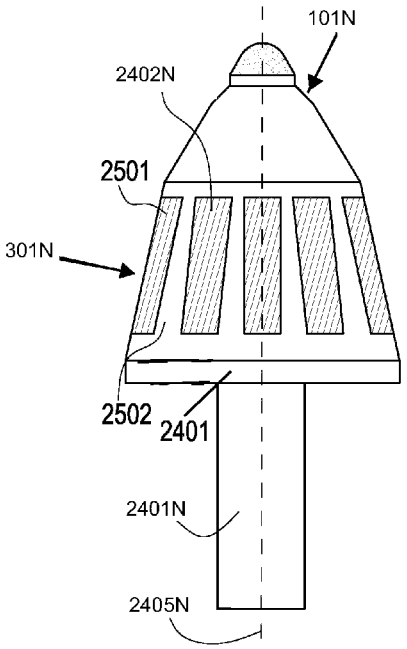
FIG. 25 is an orthogonal diagram of an embodiment of insert geometry.

FIGS. 25-30 are orthogonal diagrams of several embodiments of insert geometries. The insert 2402 N-S may comprise a generally circular shape, a generally rectangular shape, a generally annular shape, a generally spherical shape, a generally pyramidal shape, a generally conical shape, a generally accurate shape, a generally asymmetric shape, or combinations thereof. The distal most surface 2501 of the insert 2402 N may be flush with the surface 2502 of the wear-resistant base 301 N, extend beyond the surface 2502 of the wear-resistant base 301, be recessed into the surface 2502 of the wear-resistant base, or combinations thereof. An example of the insert 2402 N extending beyond the surface 2502 of the base 301 N is seen in FIG. 24. FIG. 25 discloses generally rectangular inserts 2402 N hat are aligned with a central axis 2405 N of the tool 101 N. The wear resistant base 301 N also has a shank 2104 N on the axis 2405 N. The metal segment 2401 is also seen in FIG. 25.

Figure 26:
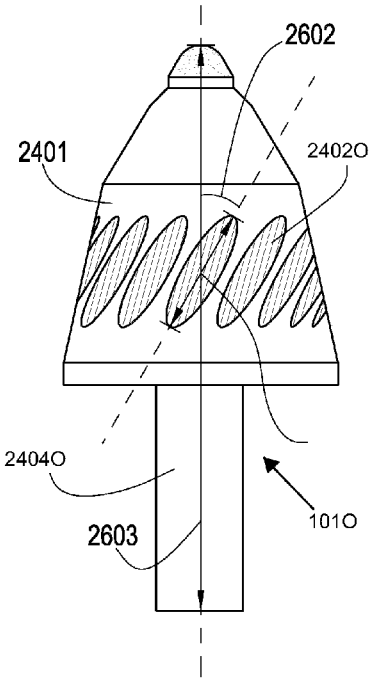
FIG. 26 is an orthogonal diagram of another embodiment of insert geometry.

FIG. 26 discloses an insert 2402 'O' comprising an axial length 2451 'O' forming an angle 2602 of 1 to 75 degrees with an axial length 2603 of the tool 101 'O'. The inserts 2402 'O' may be oblong.

Figure 27:
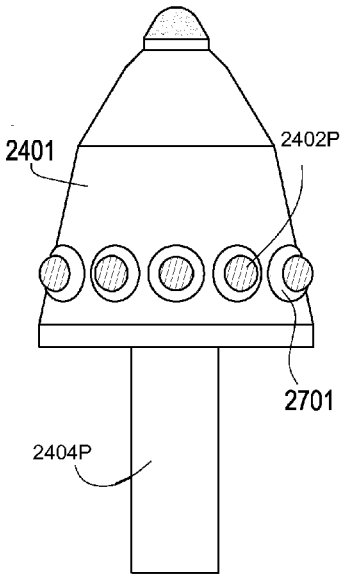
FIG. 27 is an orthogonal diagram of another embodiment of insert geometry.
Figure 28:
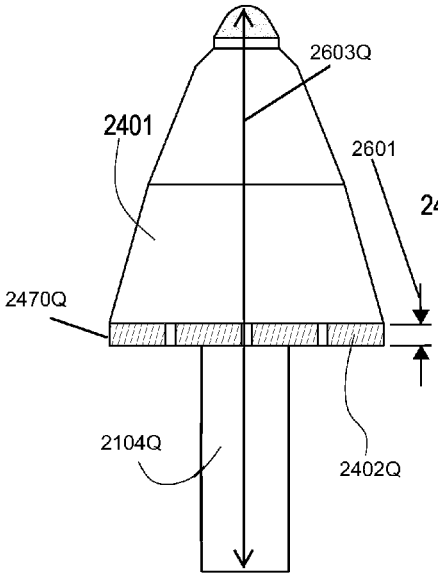
FIG. 28 is an orthogonal diagram of another embodiment of insert geometry.
Figure 29:
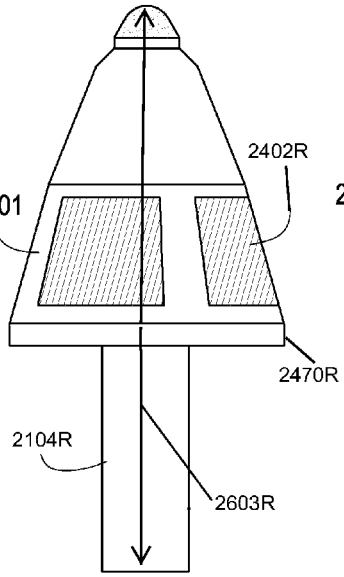
FIG. 29 is an orthogonal diagram of another embodiment of insert geometry.
Figure 30:
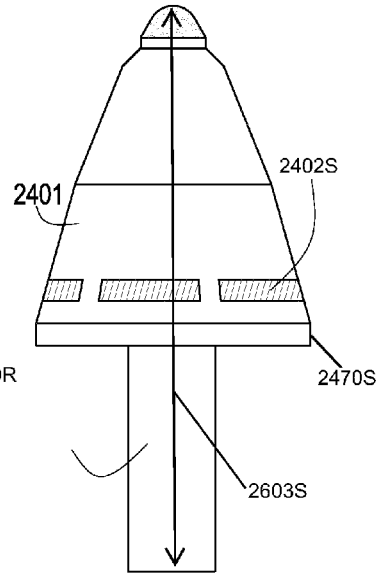
FIG. 30 is an orthogonal diagram of another embodiment of insert geometry.

FIG. 27 discloses a circular insert 2402 P bonded to a protrusion 2701 formed in the 15 base. The insert 2402 P may be flush with the surface of the protrusion 2701, extend beyond the protrusion 2701, or be recessed within the protrusion 2701. A protrusion 2701 may help extend the insert 2402 P so that the wear is decreased as the insert 2402 P takes more of the impact. FIGS. 28-30 disclose segmented inserts 2402 Q-S that may extend around the metal segment's circumference 2470 Q-S. The angle formed by insert's axial length 2601 may also be 90 degrees from the tool's axial length 2603 Q-S.

Figure 31:
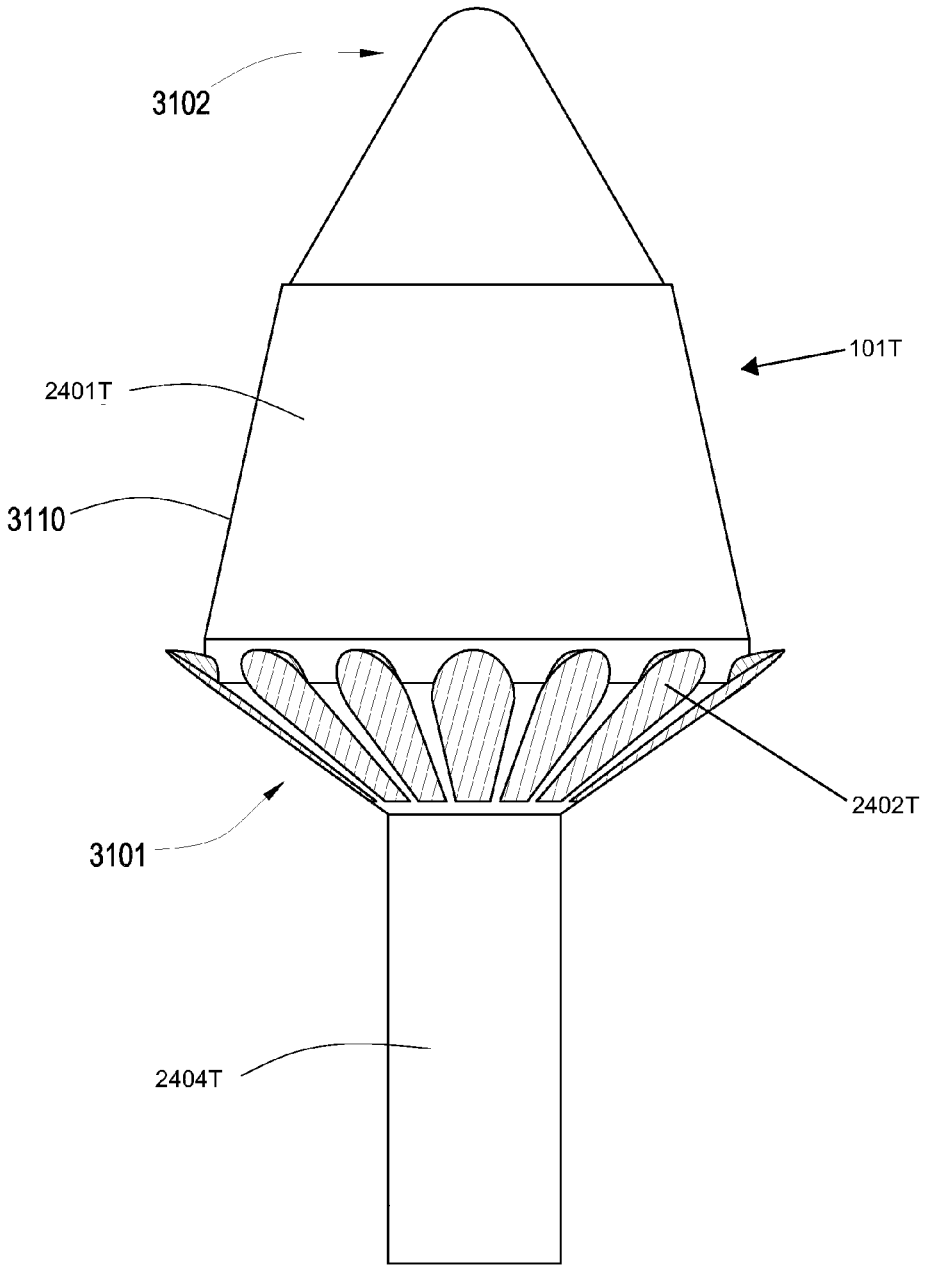
FIG. 31 is an orthogonal diagram of another embodiment of an attack tool.

FIG. 31 is an orthogonal diagram of another embodiment of a tool. The base 3110 of an attack tool 101 T may comprise a tapered region 3101 intermediate the metal segment 2401 T and the shank 2104 T. An insert 2402 T may be bonded to the tapered region 3101, and a perimeter of the insert 2402 may be within 0.5 inches of the tapered region 3101. The inserts 2402 T may extend beyond the perimeter 3110 of the tool 101 T. This may be beneficial in protecting the metal segment. A tool tip 3102 may be bonded to a cemented metal carbide, wherein the tip may comprise a layer selected from the group consisting of diamond, natural diamond, polycrystalline diamond, cubic boron nitride, infiltrated diamond, diamond impregnated carbide, diamond impregnated matrix, silicon bonded diamond, or combinations thereof. In some embodiments, a tip 3102 is formed by the first carbide segment. The first carbide segment may comprise a superhard material bonded to it although it is not required.

Figure 32:
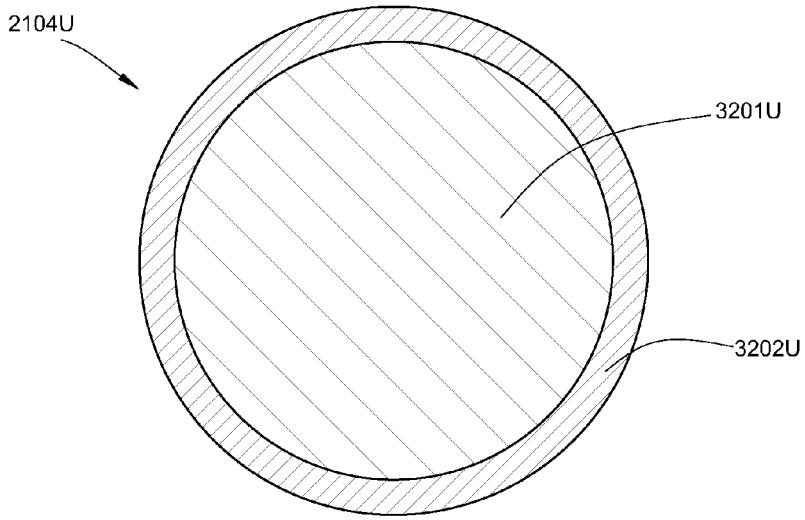
FIG. 32 is a cross-sectional diagram of an embodiment of a shank.
Figure 33:
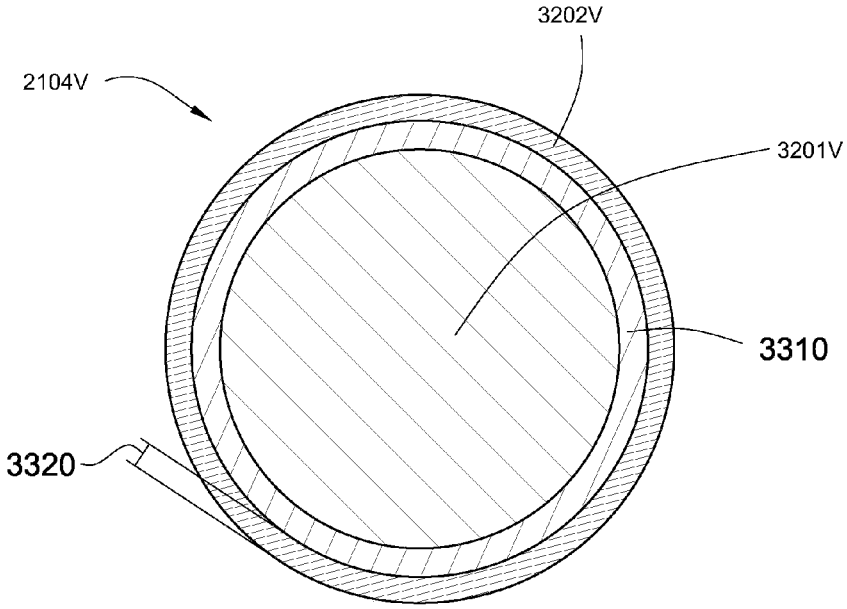
FIG. 33 is a cross-sectional diagram of another embodiment of a shank.

FIGS. 32 and 33 are cross-sectional diagrams of embodiments of the shank 2104 U and 2104 V. An attack tool may comprise a wear-resistant base suitable for attachment to a driving mechanism, the wear-resistant base comprising a shank 2104 U and 2104 V and a metal segment 2401 U and 2104 V. A cemented metal carbide segment is bonded to the metal segment; and the shank comprising a wear-resistant surface 3202 U and 3202 V, wherein the wear-resistant surface 3202 U and 3202 V comprises a hardness greater than 60 HRc.

The shank 2104 U and 2104 V and the metal segment 2401 T (FIG. 31) may be formed from a single piece of metal. The base may comprise steel having a hardness of 35 to 50 HRc. The shank 2104 U and 2104 V may comprise a cemented metal carbide, steel, manganese, nickel, chromium, titanium, or combinations thereof. If a shank 2104 U and 2104 V comprises a cemented metal carbide, the carbide may have a binder concentration of 4 to 35 percent by weight. The binder may be cobalt.

The wear-resistant surface 3202 U and 3202 V may comprise a cemented metal carbide, chromium, manganese, nickel, titanium, hard surfacing, diamond, cubic boron nitride, polycrystalline diamond, vapor deposited diamond, aluminum oxide, zircon, silicon carbide, whisker reinforced ceramics, diamond impregnated carbide, diamond impregnated matrix, silicon bonded diamond, or combinations thereof. The wear-resistant surface 3202 U and 3202 V may be bonded to the shank 2104 U and 2104 V though the processes of electroplating, cladding, electroless plating, thermal spraying, annealing, hard facing, applying high pressure, hot dipping, brazing, or combinations thereof. The surface 3202 U and 3202 V may have a thickness of 0.001 to 0.200 inches. The surface 3202 U and 3202 V may be polished. The shank 2104 U and 2104 V may also comprise layers. A core 3201 U and 3201 V may comprise steel, surrounded by a layer of another material, such as tungsten carbide. There may be one or more intermediate layers 3310 between the core 3201 V and the wear-resistant surface 3202 V that may help the wear-resistant surface 3202 V bond to the core. The wear-resistant surface 3202 V may also comprise a plurality of layers. The plurality of layers may comprise different characteristics selected from the group consisting of hardness, modulus of elasticity, strength, thickness, grain size, metal concentration, weight, and combinations thereof. The wear-resistant surface 3202 V may comprise chromium having a hardness of 65 to 75 HRc.

Figure 34:
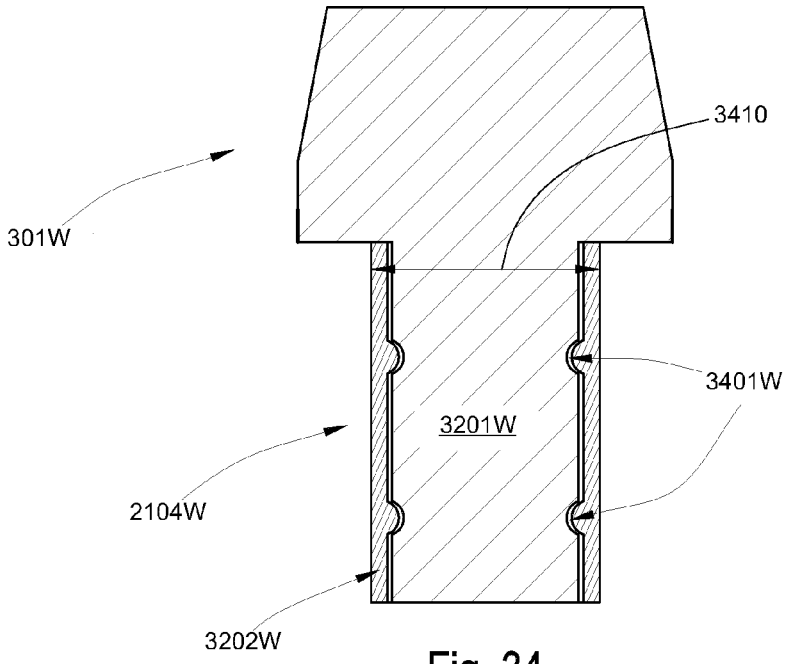
FIG. 34 is a cross-sectional diagram of an embodiment of a shank.
Figure 35:
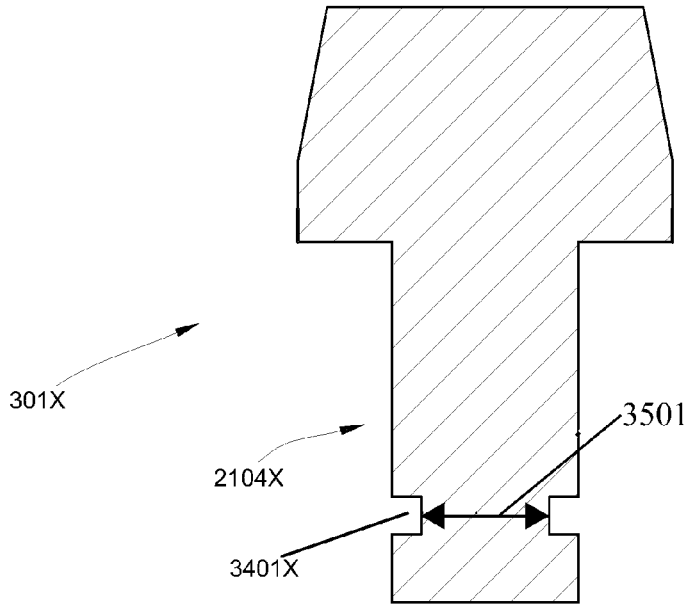
FIG. 35 is a cross-sectional diagram of another embodiment of a shank.

FIGS. 34 and 35 are orthogonal diagrams of embodiments of the bases 301 W and 301 X with shanks 2104 W and 2104 X. The shank shanks 2104 W and 2104 X may have one or more grooves 3401 W and 3401 X. The wear-resistant surface 3202 W and 3401 X may be disposed within a groove 3401 W formed in the shank 2104 W . Grooves 3401 W and 3401 X may be beneficial in increasing the bond strength between the wear-resistant surface 3202 W and core 3201 W. The bond may also be improved by swaging the wear-resistant surface 3202 W on the core 3201 W of the shank 2104 W. Additionally, the wear-resistant surface 3202 W may comprise a non-uniform diameter 3501. The non-uniform diameter 3501 may help hold a retaining member (not shown) while the tool is in use. The entire cross-sectional thickness 3410 of the shank may be harder than 60 HRc. In some embodiments, the shank may be made of a solid cemented metal carbide, or other material comprising a hardness greater than 60 HRc.

Figure 36:
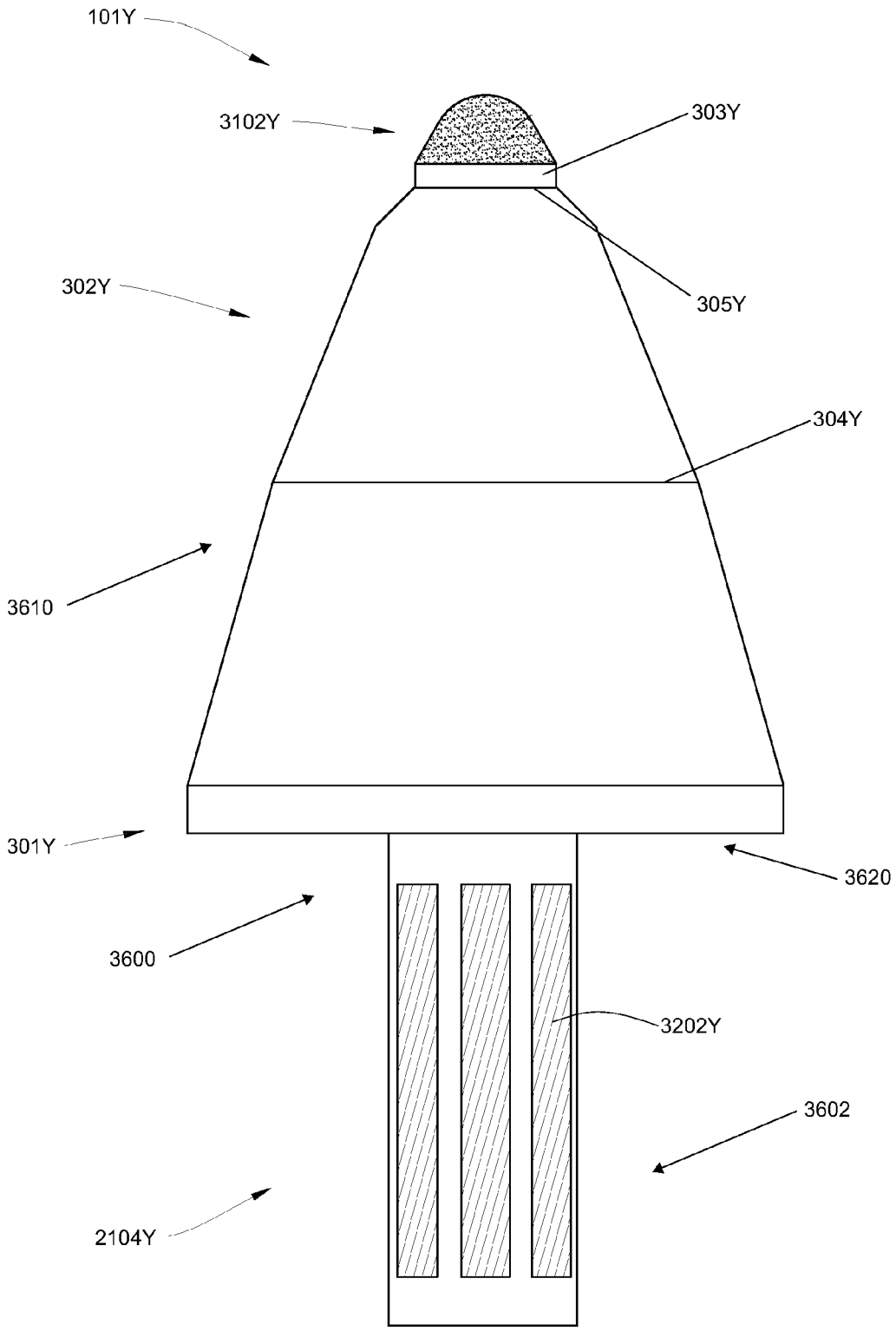
FIG. 36 is an orthogonal diagram of another embodiment of a shank.

FIG. 36 is an orthogonal diagram of another embodiment of a shank 2104 Y having a first end 3600 attached to a second end 3620 of the wear-resistant base 301 Y. The wear-resistant surface 3202 Y at a second end 3602 of the shank 2104Y may be segmented. Wear-resistant surface 3202 Y segments may have a height less than the height of the shank 2104 Y. A first cemented metal carbide segment 302Y is bonded to a first end 3610 of the wear-resistant base 301Y at a first interface 304Y and a second metal carbide segment 303Y is bonded to the first cemented metal carbide segment 302Y at a second interface 305Y opposite the first interface 304Y. The tool 101 Y may also comprise a tool tip 3102 Y which may be bonded to the second cemented metal carbide segment 303 Y and may comprise a layer selected from the group consisting of diamond, natural diamond synthetic diamond, polycrystalline diamond, infiltrated diamond, cubic boron nitride, diamond impregnated carbide, diamond impregnated matrix, silicon bonded diamond, or combinations thereof. The polycrystalline diamond may comprise a binder concentration of 4 to 35 percent by weight.

Figure 37:
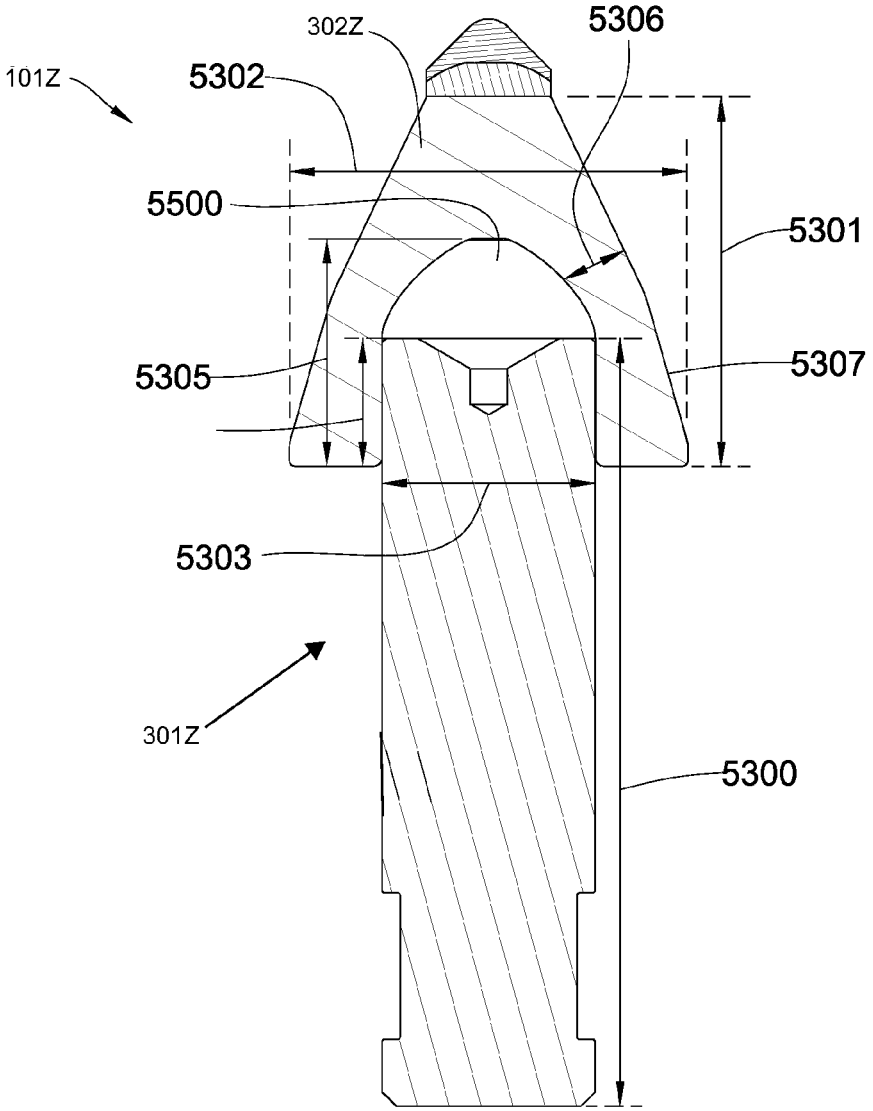
FIG. 37 is a cross-sectional diagram of another embodiment of a shank.

Referring to the embodiment of FIG. 37, dimensions of the base 301 Z and first carbide segment 302 Z may be important to the function and efficiency of the tool 101 Z. A ratio of a length 5300 of the base 301 Z to a height 5301 of the first carbide segment 302 Z may be from 1.75:1 to 2.5:1. A ratio of a width 5302 of the first carbide segment 302 Z to a width 5303 of the base 301 Z may be from 1.5:1 to 2.5:1. There may be a bore 5500 formed in the first carbide segment 302 Z which may comprise a depth 5305 from 0.600 to 1 inch. The base 301 Z may or may not extend into the full depth 5305 of the bore 5500 and is here shown extending depth 304 Z. The base 301Z and first carbide segment 302 Z may also comprise an interference fit from 0.0005 to 0.005 inches. The first carbide segment 302 Z may have a minimum cross-sectional thickness 5306 between the bore 5500 and an outer surface 5307 of the first carbide segment of 0.200 inch, preferable at least 0.210 inches. Reducing the volume of the carbide segment 302 may be advantageous by reducing the cost of the tool 101 Z. In the embodiment of FIG. 37, the base 301 Z does not include an enlarged portion, but comprises a shank that is press fit into the bore 5500 of the first cemented metal carbide. To increase the wear resistance of the base, the shank may be worked hardened, such as by peening. In embodiments after the shank has been peened, the shank may comprise a compressed layer of 0.005" -0.015", preferably about 0.010". After peening the surface may or may not exceed 60 HRc.

Figure 38:
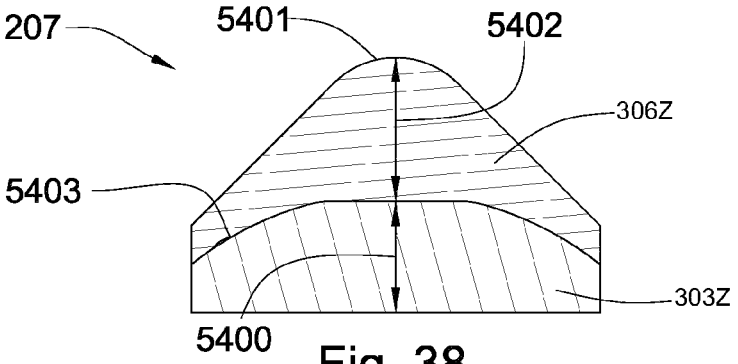
FIG. 38 is a cross-sectional diagram of an embodiment of a second cemented metal carbide segment and a superhard material.

Referring now to FIG. 38, the second cemented metal carbide segment 303 Z may comprise a center thickness 5400 from 0.090 to 0.250 inches. The super hard material 306 Z bonded to the second carbide segment 303 Z may comprise a substantially pointed geometry with an apex 5401 comprising a 0.050 to 0.160 inch radius, and a 0.100 to 0.500 inch thickness 5402 from the apex 5401 to an interface 5403 where the superhard material 306 Z is bonded to the second carbide segment 303 Z. Preferably, the interface 5403 is non-planar, which may help distribute impact loads across a larger area of the interface 5403. The side wall of the superhard material may form an included angle with a central axis of the tip between 30 to 60 degrees.

What is claimed is:

1. An attack tool for connection to a holder that is attached to a driving mechanism, said attack tool comprising:

a first metal carbide segment having a first interface and a second interface spaced apart from said first interface;

a wear-resistant base having a first end attached to said first interface, a second end opposite said first end, and a shank configured for attachment to a holder of a driving mechanism, said shank having a first end attached to said second end of said wear-resistant base and said shank having a second end that includes a wear-resistant surface bonded thereto;

a second metal carbide segment attached to said second interface; and a tool tip bonded to said second metal carbide segment and oriented to contact a formation.

2. The attack tool of claim 1, wherein said shank is formed of a material selected from the group consisting of cemented metal carbide, steel, manganese, nickel, chromium, and titanium.

3. The tool of claim 1, wherein said second end of said shank has a groove formed therein.

4. The attack tool of claim 1, wherein said wear-resistant surface is formed of a material that has a hardness greater than about 60 HRc.

5. The attack tool of claim 1, wherein said wear-resistant surface is bonded to said shank by a process selected from the group consisting of electroplating, cladding, electro less plating, thermal spraying, annealing, hard facing, applying high pressure, hot dipping, and brazing.

6. The attack tool of claim 1, wherein said wear-resistant surface is polished.

7. The attack tool of claim 1, wherein said tool tip is bonded to said second cemented metal carbide segment and wherein said tool tip is formed from a material selected from the group consisting of diamond, natural diamond, synthetic diamond, polycrystalline diamond, infiltrated diamond, cubic boron nitride, thermally stable diamond, diamond impregnated carbide, diamond impregnated matrix, and silicon bonded diamond.

8. The attack tool of claim 7, wherein said polycrystalline diamond has a binder concentration of 4 to 35 percent by weight.

9. The attack tool of claim 7, wherein said tool tip has at least two layers of polycrystalline diamond.

10. The attack tool of claim 1, wherein said wear-resistant surface has a thickness of about 0.001 inches to about 0.200 inches.

11. The attack tool of claim 1, wherein said second metal carbide segment has a non-planar surface to which said tool tip is bonded.

* * * * *